US008608296B2

(12) United States Patent
Nakatani

(10) Patent No.: US 8,608,296 B2
(45) Date of Patent: Dec. 17, 2013

(54) INKJET PRINTER HEAD

(75) Inventor: Goro Nakatani, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 168 days.

(21) Appl. No.: 12/855,416

(22) Filed: Aug. 12, 2010

(65) Prior Publication Data

US 2011/0037813 A1 Feb. 17, 2011

(30) Foreign Application Priority Data

Aug. 12, 2009 (JP) ..... 2009-187485
May 26, 2010 (JP) ..... 2010-120391

(51) Int. Cl.
*B41J 2/045* (2006.01)

(52) U.S. Cl.
USPC ..... 347/70

(58) Field of Classification Search
USPC ..... 347/68, 70–72
See application file for complete search history.

(56) References Cited

U.S. PATENT DOCUMENTS

| | | | | |
|---|---|---|---|---|
| 6,378,996 | B1 * | 4/2002 | Shimada et al. | 347/70 |
| 7,270,403 | B2 * | 9/2007 | Sanada | 347/68 |
| 8,042,916 | B2 * | 10/2011 | Wang | 347/70 |
| 2006/0158486 | A1 * | 7/2006 | Bibl et al. | 347/68 |
| 2009/0237468 | A1 * | 9/2009 | Kanemoto | 347/70 |

FOREIGN PATENT DOCUMENTS

JP 08-197730 A 8/1996

OTHER PUBLICATIONS

Merriam Webster Online Dictionary, "Lateral", 1st definition.*

* cited by examiner

*Primary Examiner* — Lisa M Solomon
(74) *Attorney, Agent, or Firm* — Rabin & Berdo, P.C.

(57) ABSTRACT

An inkjet printer head includes: a semiconductor substrate; a vibration diaphragm provided on the semiconductor substrate and capable of vibrating in an opposing direction in which the vibration diaphragm is opposed to the semiconductor substrate; a piezoelectric element provided on the vibration diaphragm; a pressure chamber provided on a side of the vibration diaphragm adjacent to the semiconductor substrate as facing the vibration diaphragm, the pressure chamber being filled with an ink; and a nozzle extending through the vibration diaphragm and communicating with the pressure chamber for ejecting the ink supplied from the pressure chamber.

11 Claims, 45 Drawing Sheets

1

(b)

(a)
3(2)
111
111
3
4
2
118
119
120
121
117
116
115
114
113
112
122
61
14
13
58
48
51
54
45
50
22
46
47
49
53
39
35
40
21
36
37
52
55
38
33
32
56
34
44
42
43
57
28
27
26
25
24
23
41
31

(b)

(a)
3(2)
3
4
151
161
2
163
153
154
155
156
157
158
159
160
152
14
13
61
58
48
51
45
54
50
22
46
47
49
53
35
39
40
21
36
37
52
55
38
42
43
41
24
57
44
28
27
25
26
34
56
23
32
31
33

INKJET PRINTER HEAD

BACKGROUND OF THE INVENTION

1. Field of the Invention

The present invention relates to a piezoelectric inkjet printer head.

2. Description of Related Art

Typical examples of MEMS (Micro-Electro-Mechanical System) devices are inkjet printer heads, which are broadly classified into a piezoelectric type (piezo type) and a thermal type (bubble type) by ink ejecting mechanism.

The piezoelectric inkjet printer head includes a silicon substrate having a pressure chamber and a diaphragm formed by micro-processing the silicon substrate. The diaphragm faces the pressure chamber from one side of the pressure chamber. A piezoelectric element is disposed on a side of the diaphragm opposite from the pressure chamber. A plate is bonded to the silicon substrate so as to close the pressure chamber from a side of the pressure chamber opposite from the diaphragm. The plate has a nozzle (ejection port) communicating with the pressure chamber. When a voltage is applied to the piezoelectric element, the diaphragm is deformed together with the piezoelectric element. The deformation of the diaphragm pressurizes an ink contained in the pressure chamber, whereby the ink is ejected from the nozzle.

In the thermal inkjet printer head, on the other hand, a heater is provided in an ink flow passage for heating ink. When the ink is heated by the heater in the ink flow passage, bubbles occurring in the ink are expanded to force out the ink from a nozzle communicating with the ink flow passage.

SUMMARY OF THE INVENTION

The piezoelectric inkjet printer head is more advantageous than the thermal inkjet printer head in that it is capable of performing a higher speed operation, but is more costly than the thermal inkjet printer head.

It is an object of the present invention to provide a piezoelectric inkjet printer head which can be produced at lower costs.

The foregoing and other objects, features and effects of the present invention will become more apparent from the following detailed description of preferred embodiments with reference to the attached drawings.

DETAILED DESCRIPTION OF PREFERRED EMBODIMENTS

Figure 1:
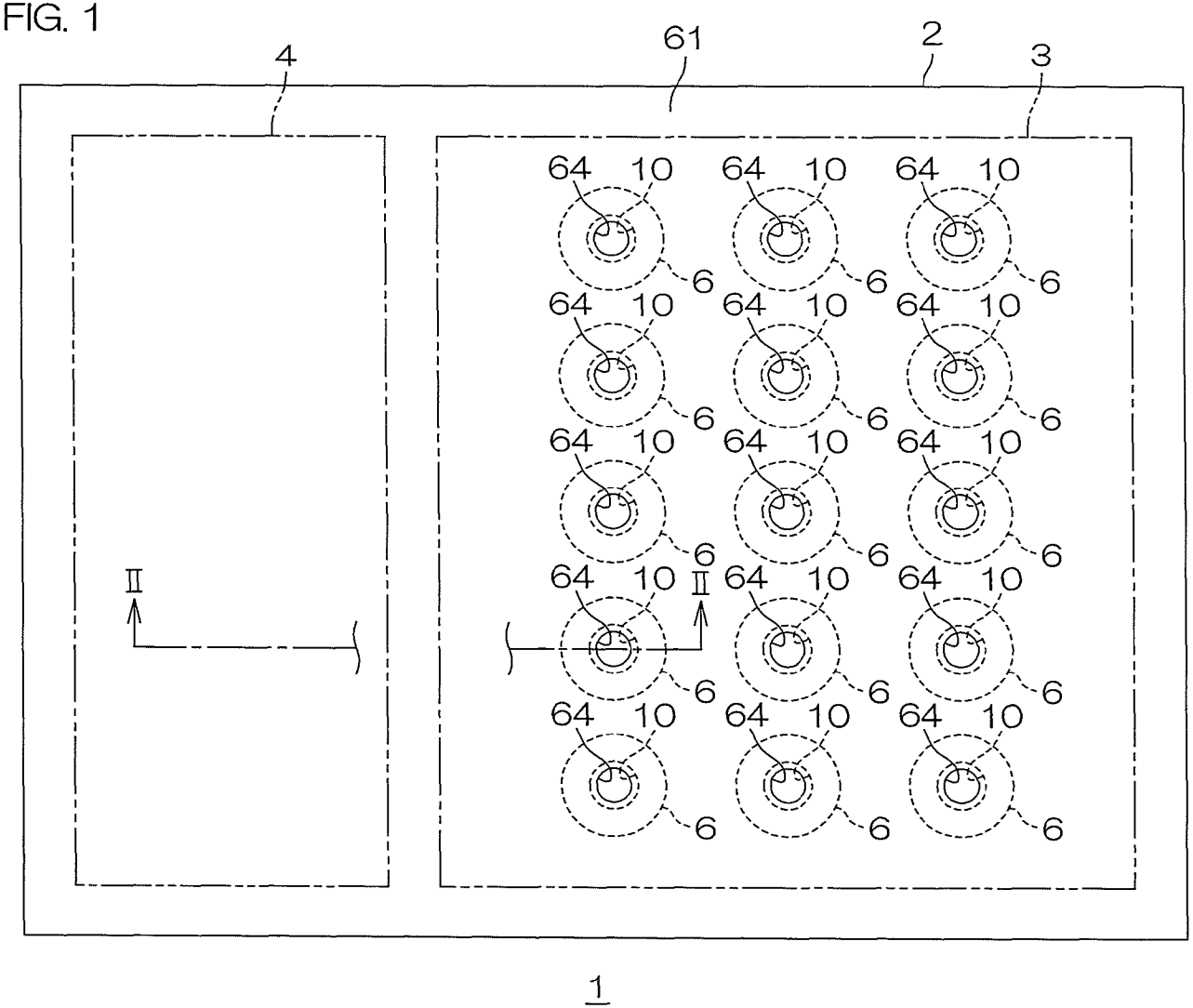
FIG. 1 is a schematic plan view of an inkjet printer head according to a first embodiment of the present invention.

An inkjet printer head according to a first aspect of the present invention includes: a semiconductor substrate; a vibration diaphragm provided on the semiconductor substrate and capable of vibrating in an opposing direction in which the vibration diaphragm is opposed to the semiconductor substrate; a piezoelectric element provided on the vibration diaphragm; a pressure chamber provided on a side of the vibration diaphragm adjacent to the semiconductor substrate as facing the vibration diaphragm, the pressure chamber being filled with an ink; and a nozzle extending through the vibration diaphragm and communicating with the pressure chamber for ejecting the ink supplied from the pressure chamber.

When a voltage is applied to the piezoelectric element on the vibration diaphragm, the vibration diaphragm is deformed together with the piezoelectric element. The deformation of the vibration diaphragm pressurizes the ink in the pressure chamber to eject the ink from the nozzle communicating with the pressure chamber.

The nozzle is provided as a through-hole which extends through the vibration diaphragm. This eliminates the need for a plate provided with a nozzle. Therefore, the inkjet printer head according to the first aspect of the present invention is simpler in construction and less costly in production than the conventional piezoelectric inkjet printer head.

A semiconductor element may be formed by utilizing the semiconductor substrate. Further, an interconnection may be provided on the semiconductor substrate with the intervention of an interlevel insulating film, and connected to the semiconductor element via a contact plug or the like. Thus, the inkjet printer head can incorporate a circuit including the semiconductor element, the interconnection and the like. Example of the circuit is a control circuit which controls the driving of the piezoelectric element (the ejection of the ink).

The vibration diaphragm may contact one surface of the semiconductor substrate, and the pressure chamber may extend thicknesswise through the semiconductor substrate. In this case, an ink tank which stores the ink to be supplied into the pressure chamber is provided on a side of the semiconductor substrate opposite from the vibration diaphragm.

The pressure chamber may be provided between the semiconductor substrate and the vibration diaphragm.

An ink supply passage communicating with the pressure chamber may be provided in the semiconductor substrate. In this case, the ink supply passage permits stable supply of the ink to the pressure chamber, so that the pressure chamber can be stably maintained in an ink filled state.

The ink supply passage may be located separately from the nozzle as seen in plan. In this case, the pressure chamber can be provided between the ink supply passage and the nozzle as seen in plan.

An ink flow passage may be provided to connect the pressure chamber and the ink supply passage. The ink flow passage permits smooth supply of the ink to the pressure chamber from the ink supply passage.

The piezoelectric element may have an annular shape to surround the nozzle.

The piezoelectric element may be disposed on a lateral side of the nozzle.

An inkjet printer head according to a second aspect of the present invention includes: a semiconductor substrate; a vibration diaphragm provided above the semiconductor substrate in a spaced relation from the semiconductor substrate and capable of vibrating in an opposing direction in which the vibration diaphragm is opposed to the semiconductor substrate; a piezoelectric element provided on the vibration diaphragm; a pressure chamber provided between the semiconductor substrate and the vibration diaphragm, the pressure chamber being filled with an ink; and a nozzle provided between the semiconductor substrate and the vibration diaphragm and communicating with the pressure chamber for ejecting the ink supplied from the pressure chamber.

When a voltage is applied to the piezoelectric element on the vibration diaphragm, the vibration diaphragm is deformed together with the piezoelectric element. The deformation of the vibration diaphragm pressurizes the ink in the pressure chamber to eject the ink from the nozzle communicating with the pressure chamber.

The nozzle is provided between the semiconductor substrate and the vibration diaphragm. This eliminates the need for a plate formed with a nozzle. Therefore, the inkjet printer head according to the second aspect of the present invention is simpler in construction and less costly in production than the conventional piezoelectric inkjet printer head.

In this inkjet printer head, a semiconductor element may be formed by utilizing the semiconductor substrate. Thus, the inkjet printer head can incorporate a circuit including the semiconductor element, an interconnection and the like.

The pressure chamber may be provided between the semiconductor substrate and the vibration diaphragm.

In the inkjet printer head according to either the first aspect or the second aspect of the present invention, a driving circuit which applies the voltage to the piezoelectric element may be provided in the semiconductor substrate provided with the vibration diaphragm. Thus, a main body of the inkjet printer head and the driving circuit can be integrated into a single chip.

With reference to the attached drawings, the present invention will hereinafter be described in detail by way of embodiments thereof.

Figure 2:
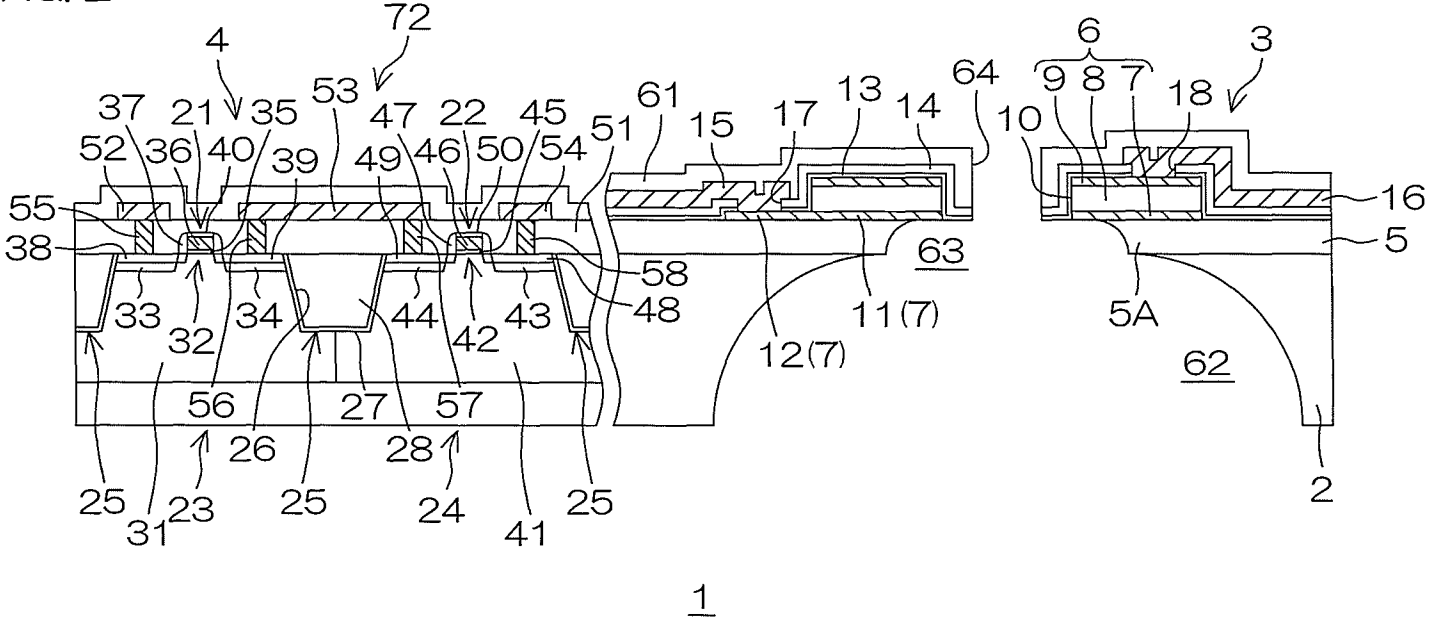
FIG. 2 is a schematic sectional view of the inkjet printer head taken along a section line II-II in FIG. 1.

FIG. 1 is a schematic plan view of an inkjet printer head according to a first embodiment of the present invention. FIG. 2 is a schematic sectional view of the inkjet printer head taken along a section line II-II in FIG. 1. In FIG. 2, only electrically conductive portions are hatched, and the other portions are not hatched.

The inkjet printer head 1 includes a silicon substrate 2. A nozzle formation region 3 and a circuit formation region 4 are defined in the silicon substrate 2.

As shown in FIG. 2, a vibration diaphragm 5 is provided in the entire nozzle formation region 3 on a front surface of the silicon substrate 2. The vibration diaphragm 5 is formed of $SiO_2$ (silicon oxide). The vibration diaphragm 5 has a thickness of, for example, 0.5 to 2 μm.

As shown in FIG. 1, a plurality of piezoelectric elements 6 are arranged equidistantly in row and column directions in a matrix array. The piezoelectric elements 6 each include a lower electrode 7, a piezoelectric member 8 provided on the lower electrode 7, and an upper electrode 9 provided on the piezoelectric member 8. In other words, the piezoelectric elements 6 are each configured such that the piezoelectric member 8 is held between the upper electrode 9 and the lower electrode 7 from upper and lower sides thereof. The piezoelectric elements 6 each have a through-hole 10 extending thicknesswise therethrough.

The lower electrode 7 integrally includes a main portion 11 having an annular plan shape, and an extension portion 12 linearly extending from the periphery of the main portion 11. The lower electrode 7 has a double layer structure including a Ti (titanium) layer and a Pt (platinum) layer stacked in this order from the side of the vibration diaphragm 5.

The piezoelectric member 8 has an annular plan shape conformal to the main portion 11 of the lower electrode 7. The piezoelectric member 8 is formed of PZT (lead titanate zirconate $Pb(Zr,Ti)O_3$).

The upper electrode 9 has an annular plan shape conformal to the piezoelectric member 8. The upper electrode 9 has a double layer structure including an $IrO_2$ (iridium oxide) layer and an Ir (iridium) layer stacked in this order from the side of the piezoelectric member 8.

In the nozzle formation region 3, surfaces of the vibration diaphragm 5 and the piezoelectric elements 6 are covered with a hydrogen barrier film 13. The hydrogen barrier film 13 is formed of $Al_2O_3$ (alumina). This prevents the degradation of the piezoelectric members 8 which may otherwise occur due to hydrogen reduction.

An interlevel insulating film 14 is provided on the hydrogen barrier film 13. The interlevel insulating film 14 is formed of $SiO_2$.

Interconnections 15, 16 are provided on the interlevel insulating film 14. The interconnections 15, 16 are each formed of a metal material containing Al (aluminum).

The interconnections 15 each have opposite ends, one of which is disposed above a distal end of the extension portion 12 of the lower electrode 7. A through-hole 17 extends continuously through the hydrogen barrier film 13 and the interlevel insulating film 14 between the one end of the interconnection 15 and the extension portion 12. The one end of the interconnection 15 is inserted in the through-hole 17 to be connected to the extension portion 12 in the through-hole 17.

The interconnections 16 each have opposite ends, one of which is disposed above the periphery of the upper electrode 9. A through-hole 18 extends continuously through the hydrogen barrier film 13 and the interlevel insulating film 14 between the one end of the interconnection 16 and the upper electrode 9. The one end of the interconnection 16 is inserted in the through-hole 18 to be connected to the upper electrode 9 in the through-hole 18.

The other ends of the interconnections 15, 16 are connected to a driver 72 (see, FIG. 3) to be described later.

In the circuit formation region 4, an integrated circuit is provided which, for example, includes N-channel MOSFETs (Negative-Channel Metal Oxide Semiconductor Field Effect Transistors) 21 and P-channel MOSFETs (Positive-Channel Metal Oxide Semiconductor Field Effect Transistors) 22.

In the circuit formation region 4, an NMOS region 23 provided with the N-channel MOSFETs 21 and a PMOS region 24 provided with the P-channel MOSFETs 22 are isolated from their neighboring portions by a device isolation portion 25. The device isolation portion 25 includes a thermal oxide film 27 provided in an interior surface of a trench 26 recessed in the silicon substrate 2 to a smaller depth from the front surface of the silicon substrate 2 (e.g., a shallow trench having a depth of 0.2 to 0.5 μm), and an insulator 28 completely filling the inside of the thermal oxide film 27. The insulator 28 is formed of, for example, $SiO_2$. A surface of the insulator 28 is flush with the front surface of the silicon substrate 2.

A P-type well 31 is provided in the NMOS region 23. The P-type well 31 has a greater depth than the trench 26. The N-channel MOSFETs 21 each include a source region 33 and a drain region 34 of an N-type provided on opposite sides of a channel region 32 in a surface portion of the P-type well 31. End portions of the source region 33 and the drain region 34 adjacent to the channel region 32 each have a smaller depth and a lower impurity concentration. That is, the N-channel MOSFETs 21 each have an LDD (Lightly Doped Drain) structure.

The N-channel MOSFETs 21 each include a gate insulating film 35 provided on the channel region 32. The gate insulating film 35 is formed of $SiO_2$.

The N-channel MOSFETs 21 each include a gate electrode 36 provided on the gate insulating film 35. The gate electrode 36 is formed of N-type polysilicon.

The N-channel MOSFETs 21 each include a sidewall 37 provided around the gate insulating film 35 and the gate electrode 36. The sidewall 37 is formed of SiN.

The N-channel MOSFETs 21 each include silicide layers 38, 39, 40 respectively provided on surfaces of the source region 33, the drain region 34 and the gate electrode 36.

An N-type well 41 is provided in the PMOS region 24. The N-type well 41 has a greater depth than the trench 26. The P-channel MOSFETs 22 each include a source region 43 and a drain region 44 of a P-type provided on opposite sides of a channel region 42 in a surface portion of the N-type well 41. End portions of the source region 43 and the drain region 44 adjacent to the channel region 42 each have a smaller depth and a lower impurity concentration. That is, the P-channel MOSFETs 22 each have an LDD structure.

The P-channel MOSFETs 22 each include a gate insulating film 45 provided on the channel region 42. The gate insulating film 45 is formed of $SiO_2$.

The P-channel MOSFETs 22 each include a gate electrode 46 provided on the gate insulating film 45. The gate electrode 46 is formed of P-type polysilicon.

The P-channel MOSFETs 22 each include a sidewall 47 provided around the gate insulating film 45 and the gate electrode 46. The sidewall 47 is formed of SiN.

The P-channel MOSFETs 22 each include silicide layers 48, 49, 50 respectively provided on surfaces of the source region 43, the drain region 44 and the gate electrode 46.

In the circuit formation region 4, an interlevel insulating film 51 is provided on the front surface of the silicon substrate 2. The interlevel insulating film 51 is formed of $SiO_2$.

Interconnections 52, 53, 54 are provided on the interlevel insulating film 51. The interconnections 52, 53, 54 are each formed of a metal material containing Al (aluminum).

The interconnection 52 is provided above the source region 33. A contact plug 55 extends through the interlevel insulating film 51 between the interconnection 52 and the source region 33 for electrical connection between the interconnection 52 and the source region 33. The contact plug 55 is formed of W (tungsten).

The interconnection 53 is provided above the drain region 34 and the drain region 44 as extending between the drain region 34 and the drain region 44. A contact plug 56 extends through the interlevel insulating film 51 between the interconnection 53 and the drain region 34 for electrical connection between the interconnection 53 and the drain region 34. Further, a contact plug 57 extends through the interlevel insulating film 51 between the interconnection 53 and the drain region 44 for electrical connection between the interconnection 53 and the drain region 44. The contact plugs 56, 57 are each formed of W.

The interconnection 54 is provided above the source region 43. A contact plug 58 extends through the interlevel insulating film 51 between the interconnection 54 and the source region 43 for electrical connection between the interconnection 54 and the source region 43. The contact plug 58 is formed of W.

A surface protecting film 61 is provided on an outermost surface of the inkjet printer head 1. The surface protecting film 61 is formed of SiN. The interlevel insulating films 14, 51 and the interconnections 15, 16, 52, 53, 54 are covered with the surface protecting film 61.

In opposed relation to each of the piezoelectric elements 6, a pressure chamber 62 is provided in the silicon substrate 2 as extending thicknesswise through the silicon substrate 2. The pressure chamber 62 has, for example, a generally semicircular cross section having a width (opening area) that is reduced toward the front surface of the silicon substrate 2. An ink tank (not shown) which stores an ink is attached to a rear surface of the silicon substrate 2. The ink is supplied into the pressure chamber 62 from the ink tank, whereby the pressure chamber 62 is filled with the ink.

A communication chamber 63 is provided in the vibration diaphragm 5 as extending thicknesswise through the vibration diaphragm 5 to face the pressure chamber 62. A portion 5A of the vibration diaphragm 5 around the communication chamber 63 faces the pressure chamber 62, and serves as a vibration portion which is flexible enough to vibrate in an opposing direction in which the vibration portion is opposed to the pressure chamber 62.

Further, a nozzle 64 is provided in the through-hole 10 of the piezoelectric element 6 as extending through the hydrogen barrier film 13, the interlevel insulating film 14 and the surface protective film 61. In other words, the piezoelectric elements 6 except for the extension portions 12 of the lower electrodes 7 each have an annular shape to surround the nozzle 64 extending through the hydrogen barrier film 13, the interlevel insulating film 14 and the surface protective film 61. In other words, the piezoelectric elements 6 each have an annular shape to laterally surround the nozzle 64. The term "laterally" is herein defined as being laterally parallel to the front surface of the silicon substrate 2. The nozzle 64 communicates with the pressure chamber 62 through the communication chamber 63.

Figure 3:
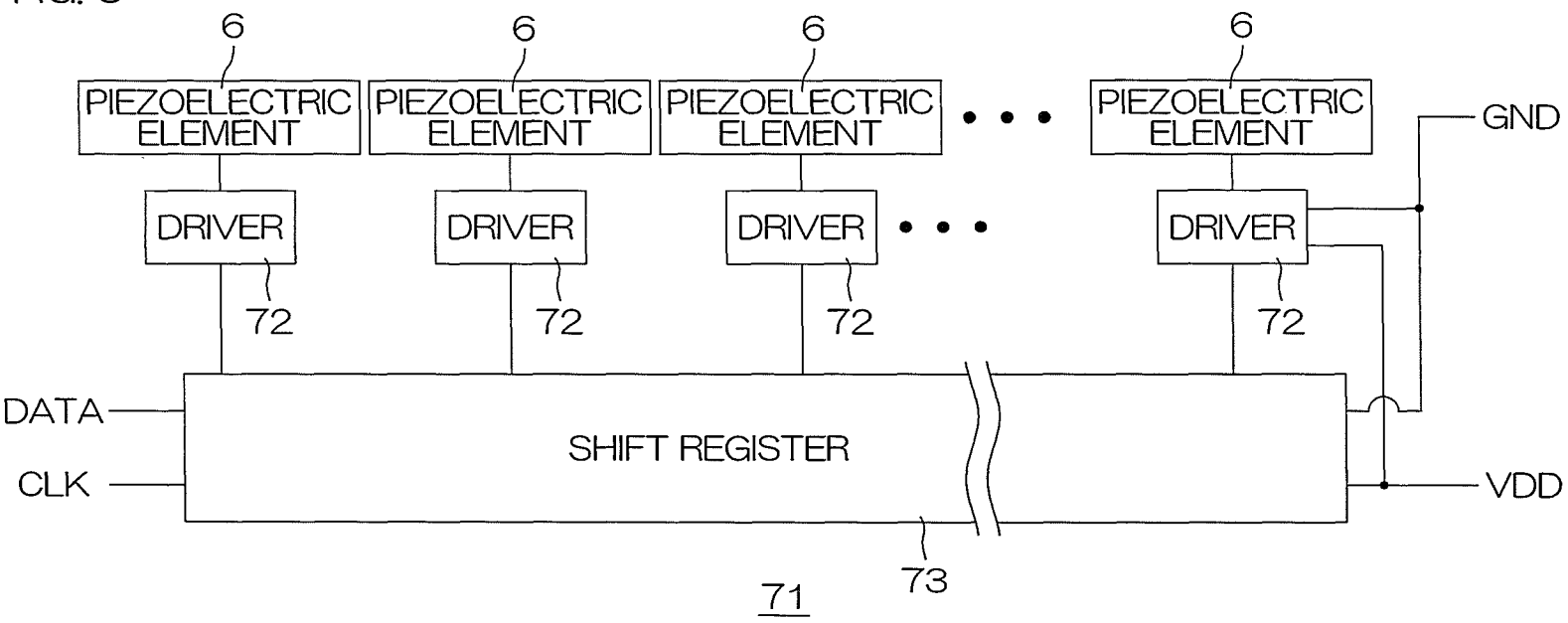
FIG. 3 is a block diagram of an integrated circuit provided in a circuit formation region shown in FIG. 1.

FIG. 3 is a block diagram of an integrated circuit provided in the circuit formation region shown in FIG. 1.

An exemplary integrated circuit to be provided in the circuit formation region 4 is a control circuit 71 which controls the driving (ink ejection) of the respective piezoelectric elements 6. The control circuit 71 includes a plurality of drivers (driving circuits) 72 respectively connected to the piezoelectric elements 6, and a serial-in parallel-out shift register 73 connected to the respective drivers 72. The N-channel MOSFETs 21 and the P-channel MOSFETs 22 shown in FIG. 2 are employed, for example, for the drivers 72.

The drivers 72 are each connected to a source voltage VDD and ground GND.

The shift register 73 is also connected to the source voltage VDD and the ground GND. The shift register 73 has a clock terminal and a data terminal. A clock CLK is inputted to the clock terminal. Data DATA of an image to be formed on a sheet is inputted to the data terminal. In the shift register 73, the data DATA inputted from the data terminal is shifted (transferred) between flip-flops every time the clock CLK is inputted from the clock terminal.

Based on the data DATA retained in the shift register 73, a voltage is applied to each of the piezoelectric elements 6 from the corresponding driver 72. Upon the application of the voltage to the piezoelectric element 6 from the driver 72, the vibration portion 5A of the vibration diaphragm 5 is deformed together with the piezoelectric element 6. The deformation pressurizes the ink in the pressure chamber 62 to eject the ink from the nozzle 64.

Figure 4A:
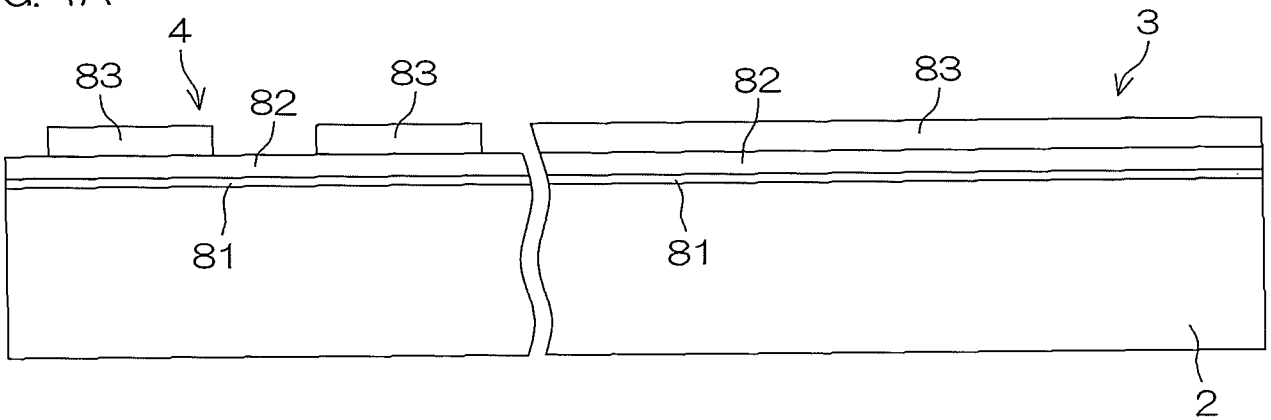
FIGS. 4A to 4S are schematic sectional views for explaining a process for producing the inkjet printer head shown in FIG. 2.
Figure 4B:
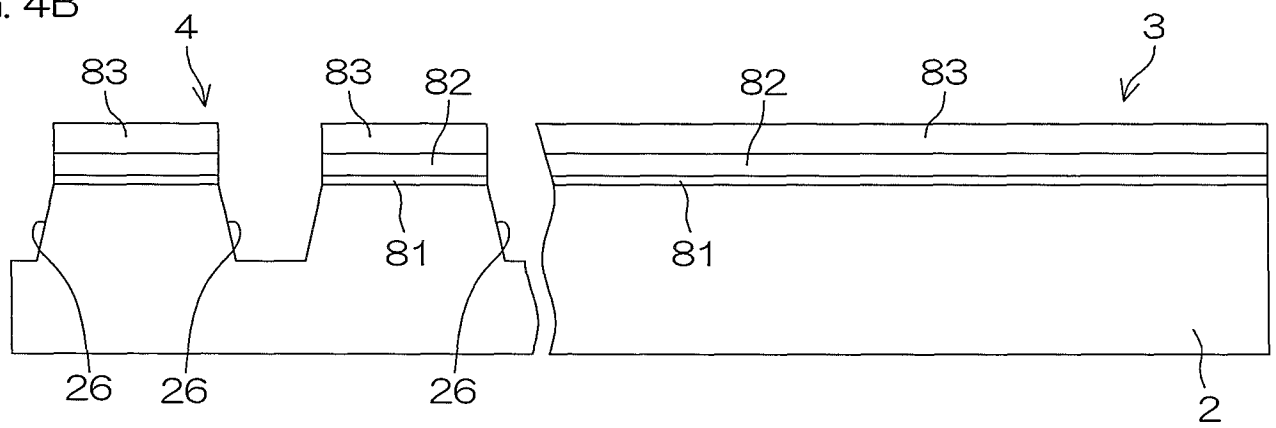
Figure 4C:
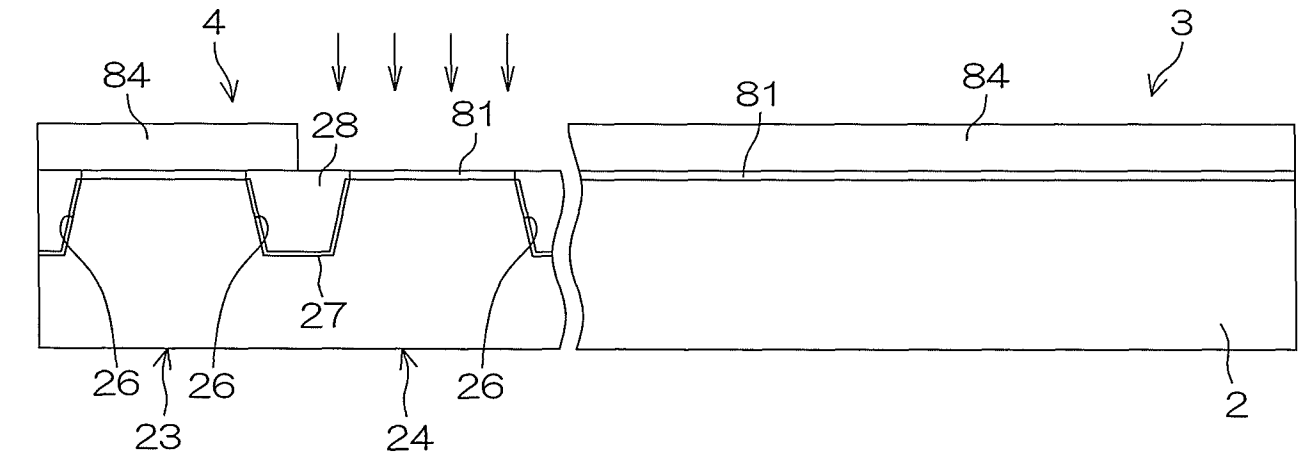
Figure 4D:
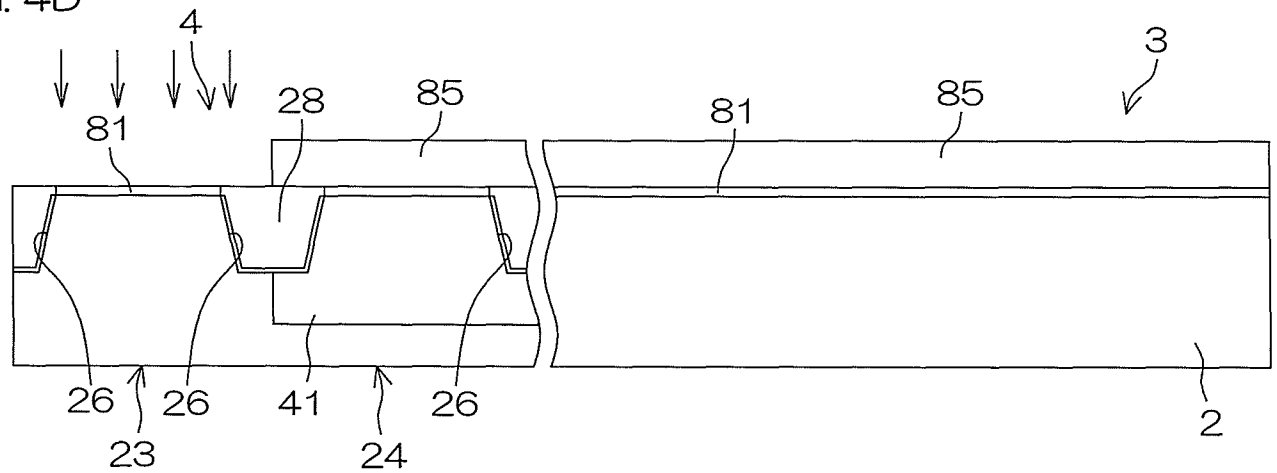
Figure 4E:
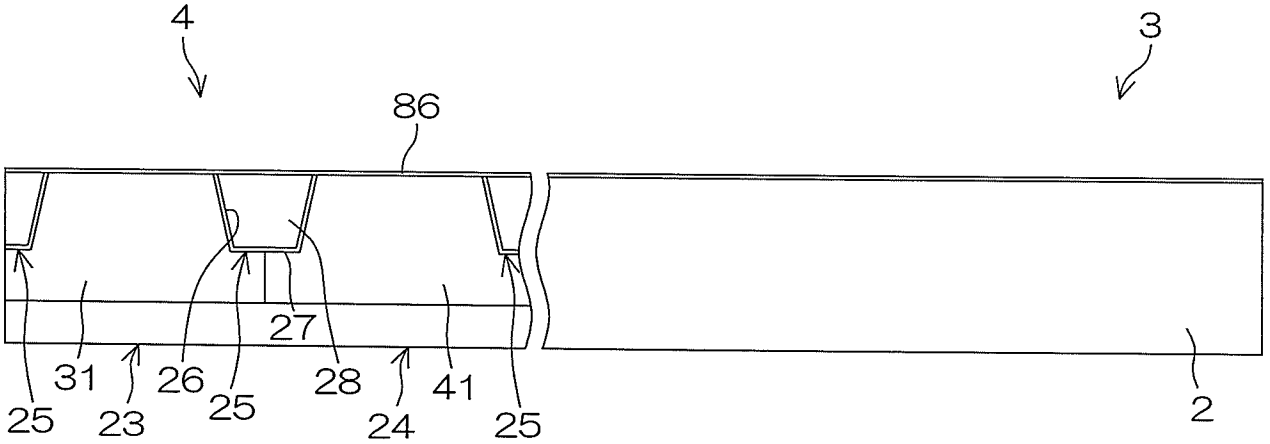
Figure 4F:
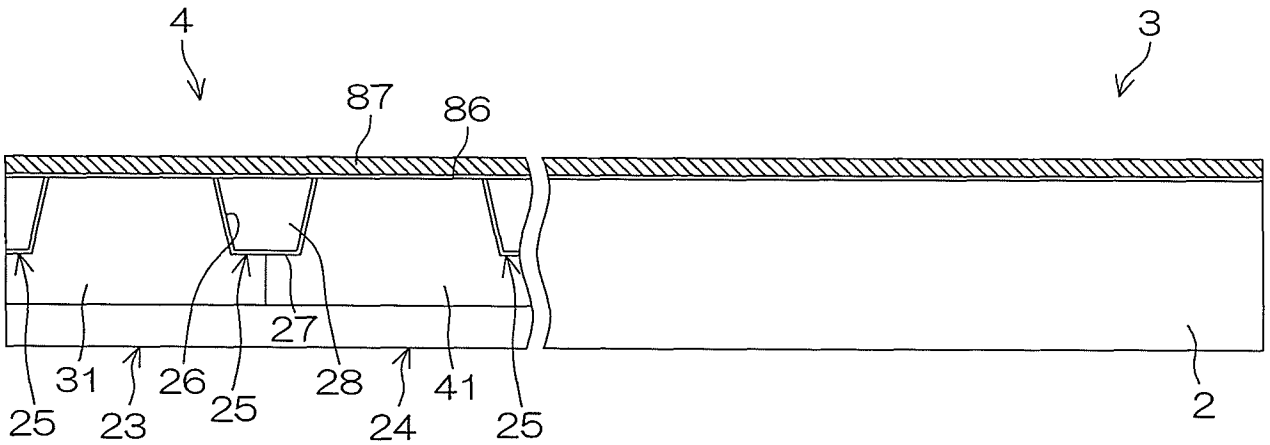
Figure 4G:
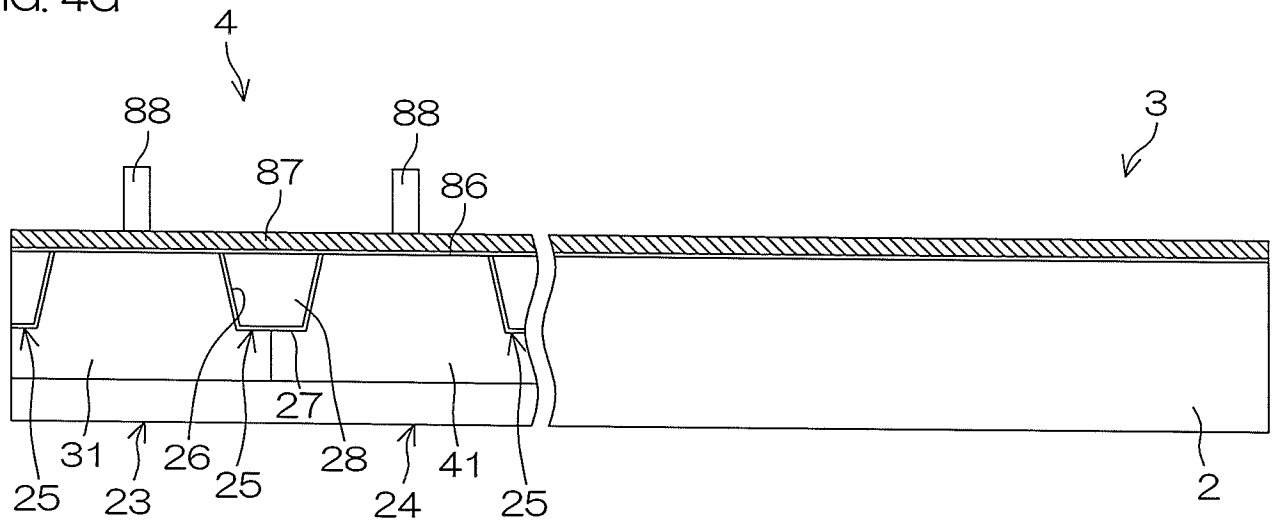
Figure 4H:
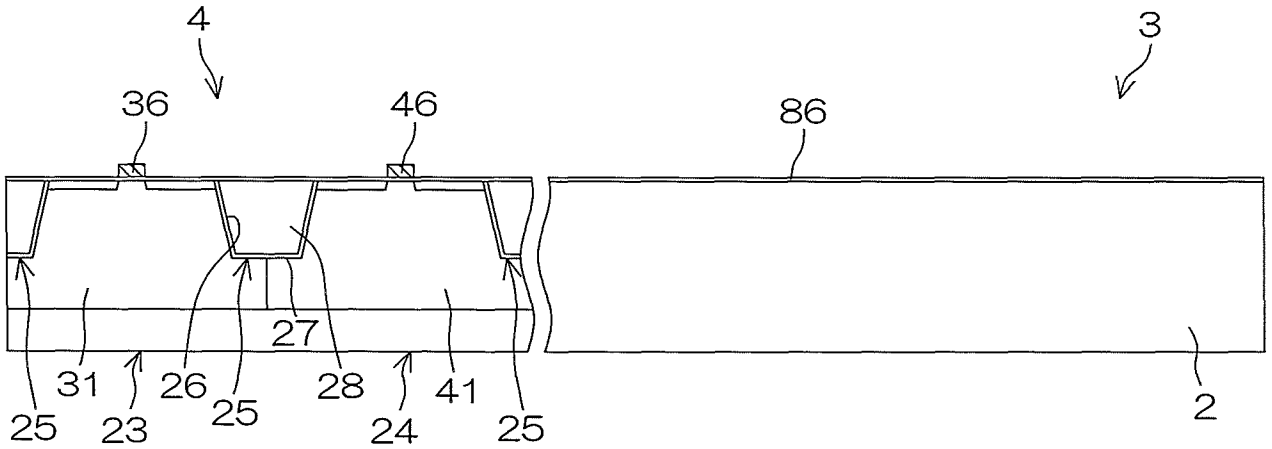
Figure 4I:
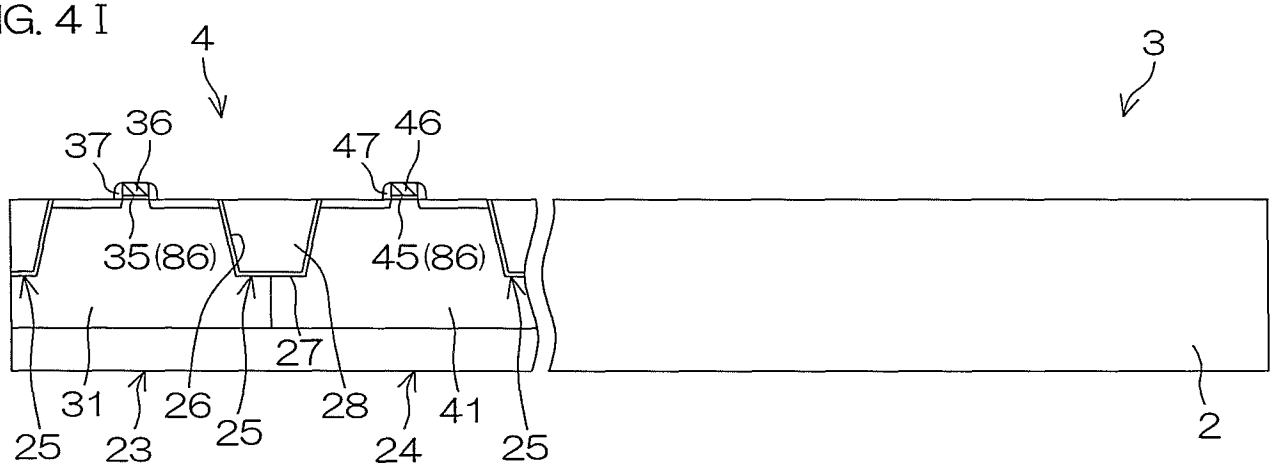
Figure 4J:
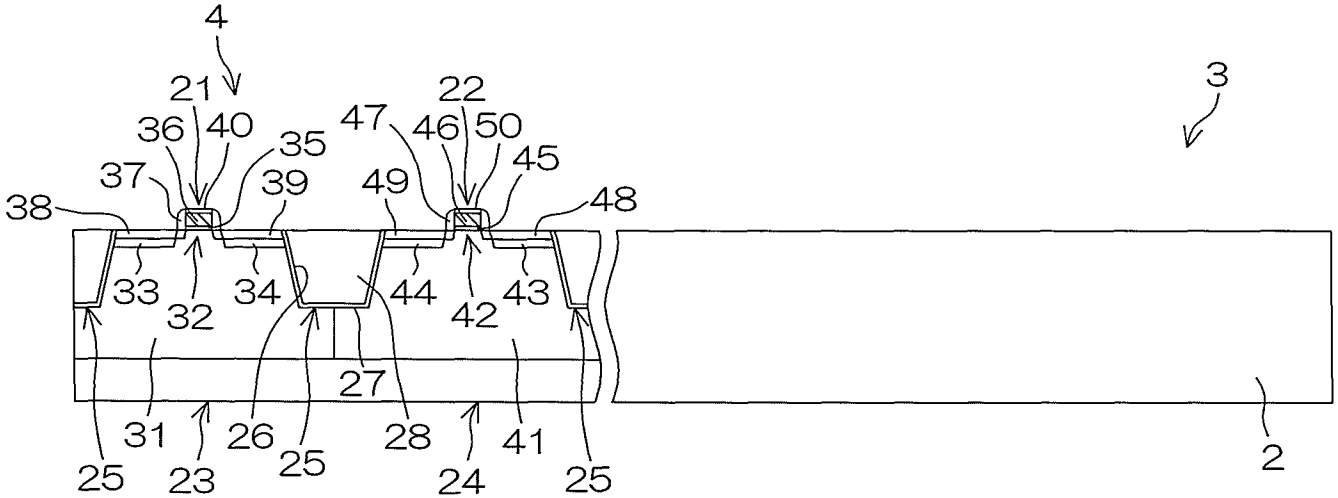
Figure 4K:
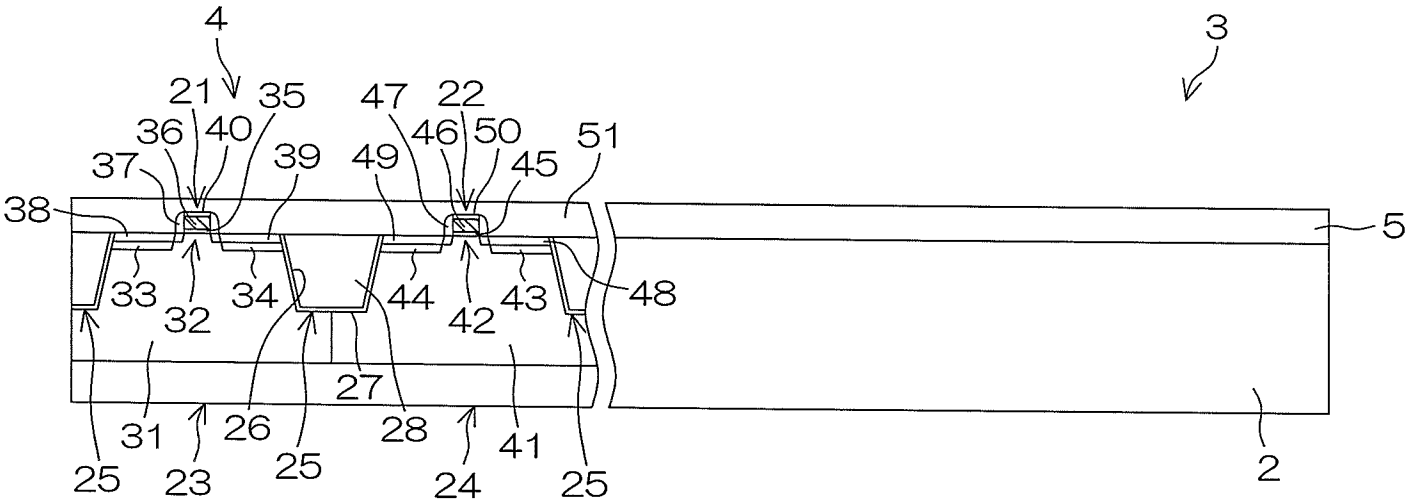
Figure 4L:
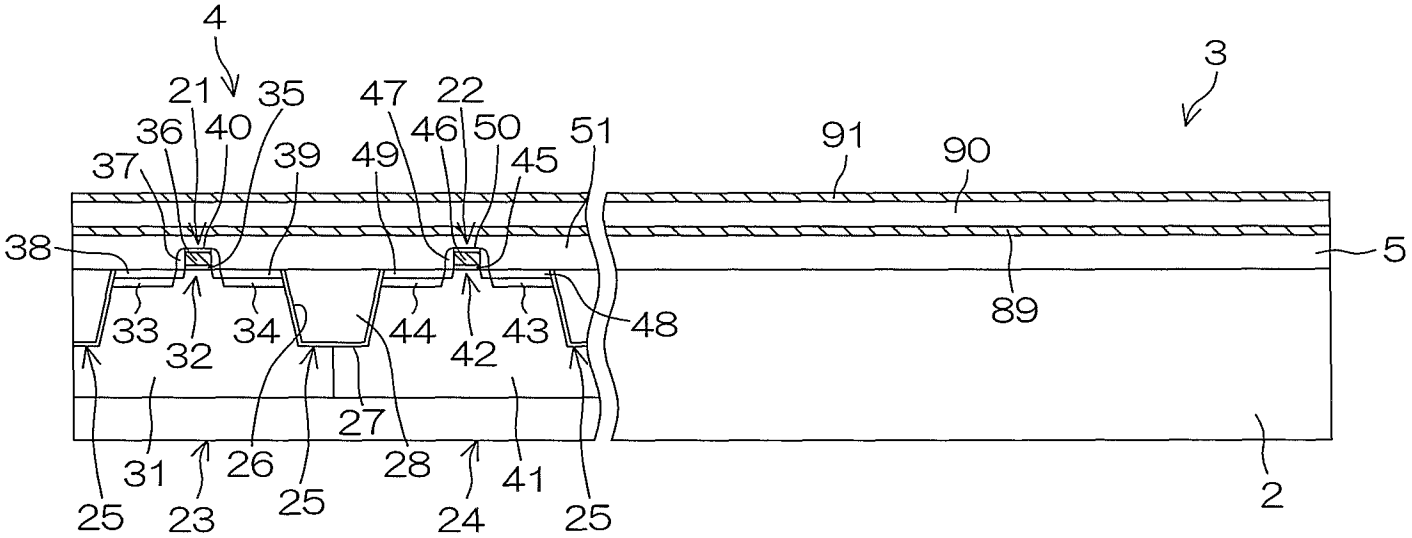
Figure 4M:
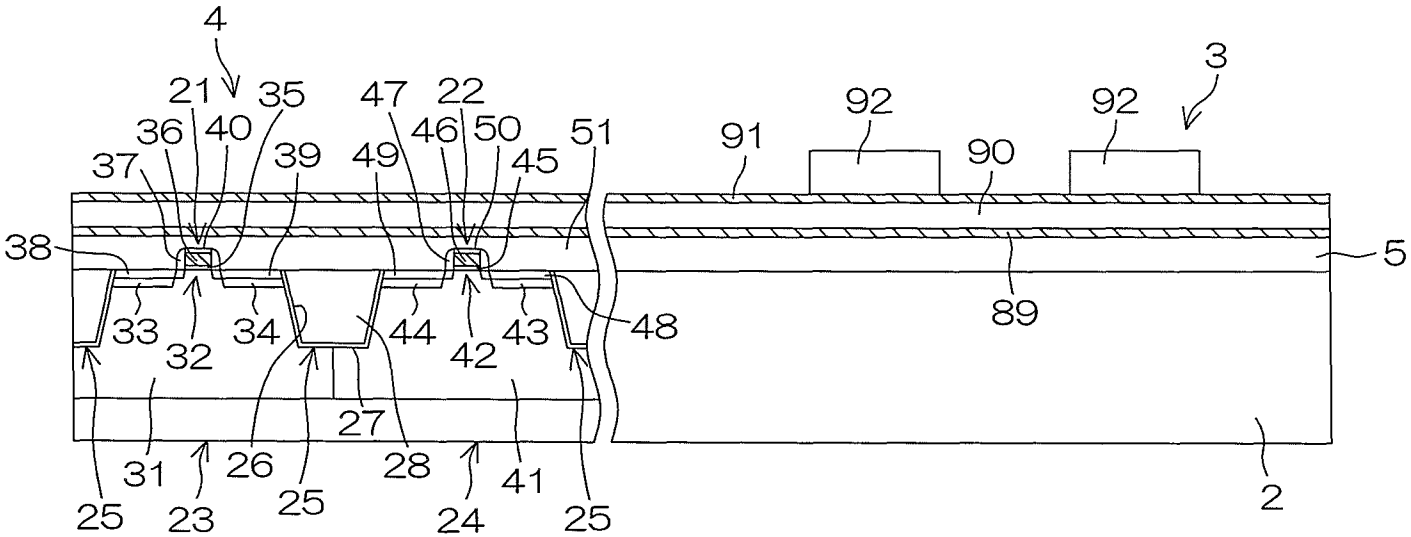
Figure 4N:
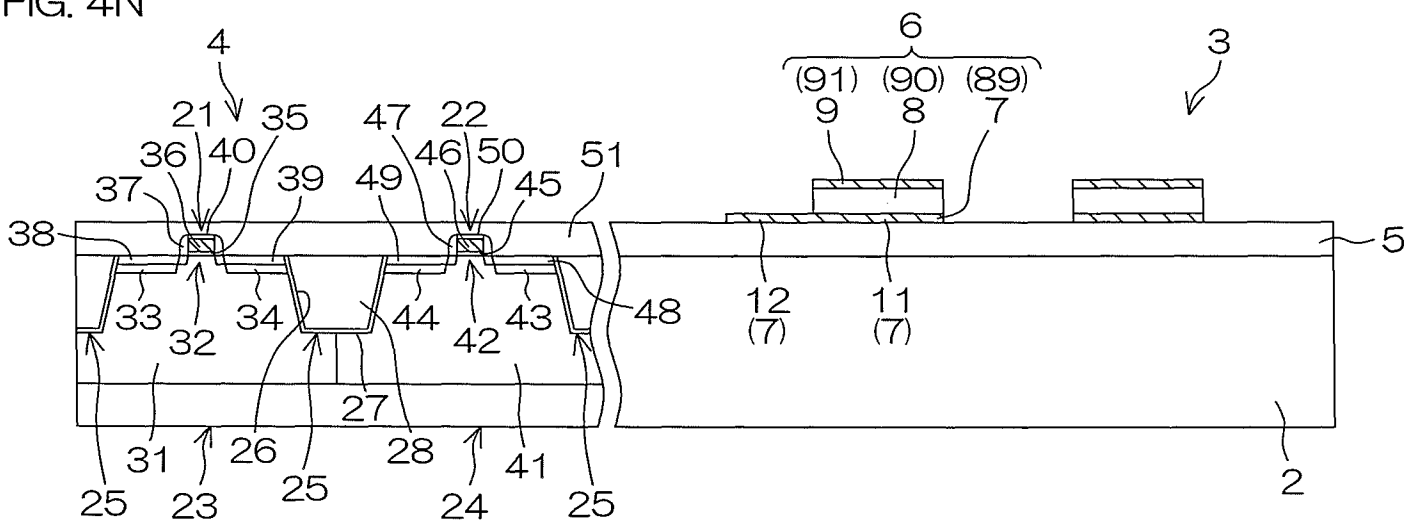
Figure 40:
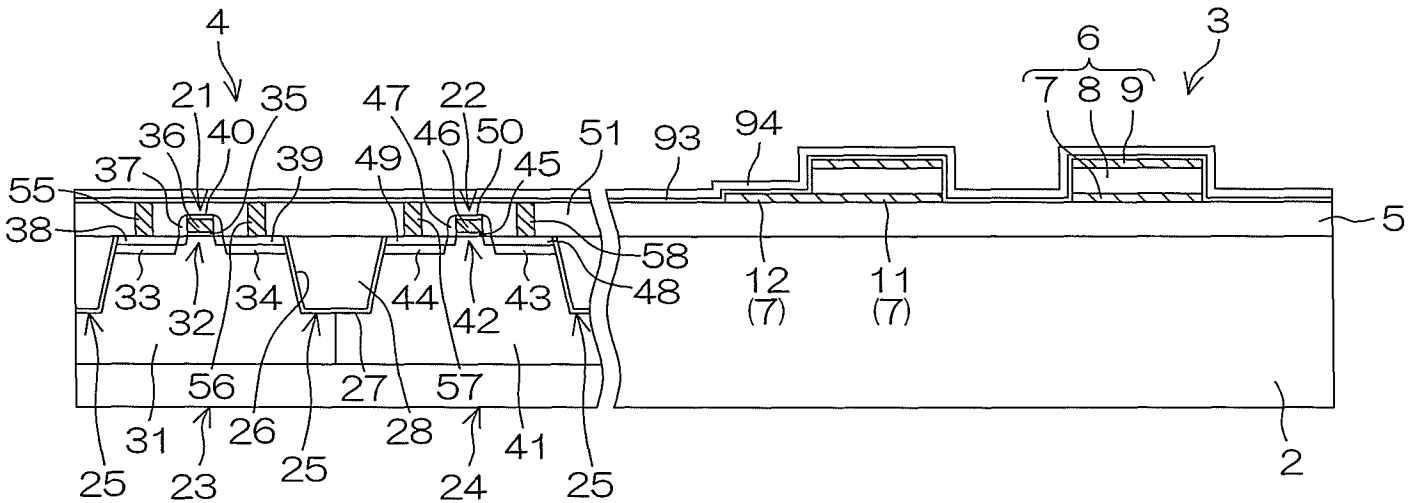
Figure 4P:
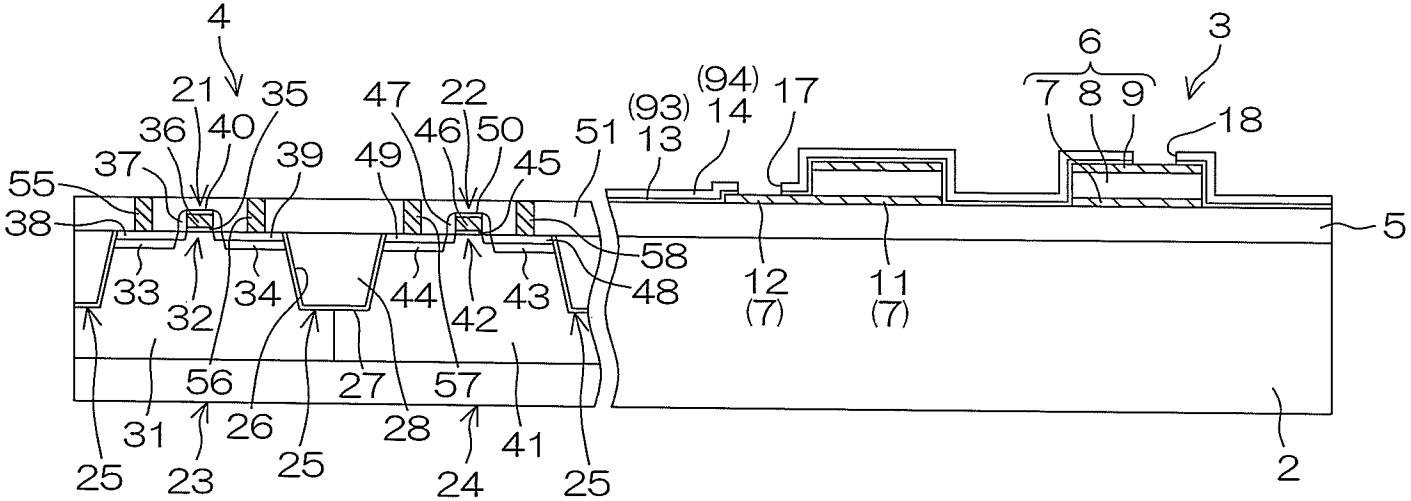
Figure 4Q:
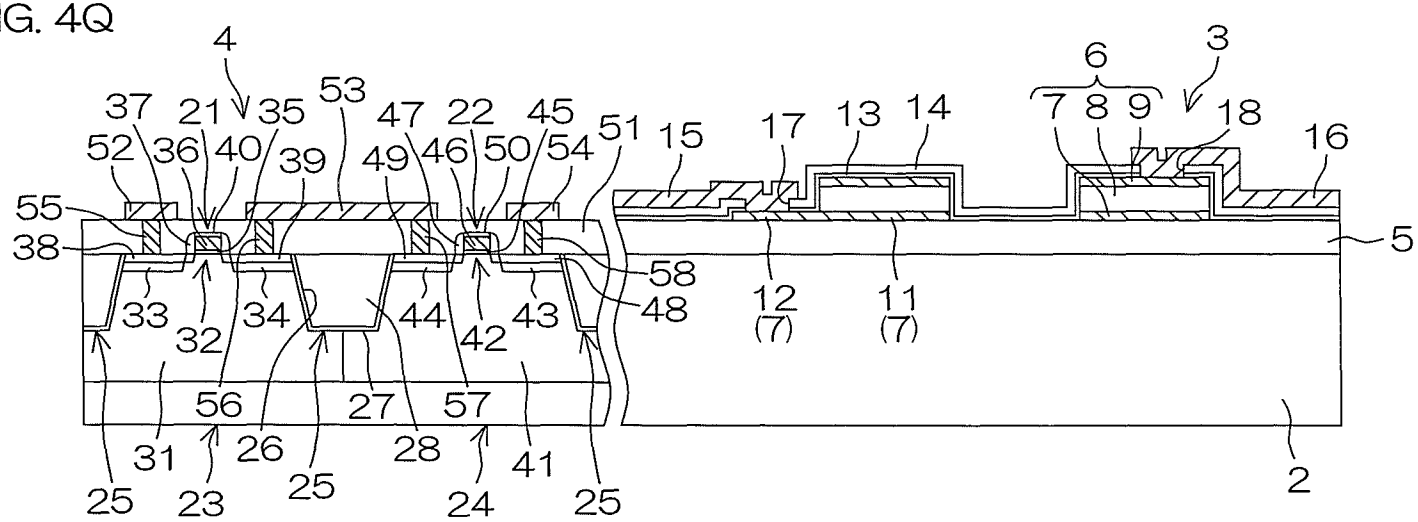
Figure 4R:
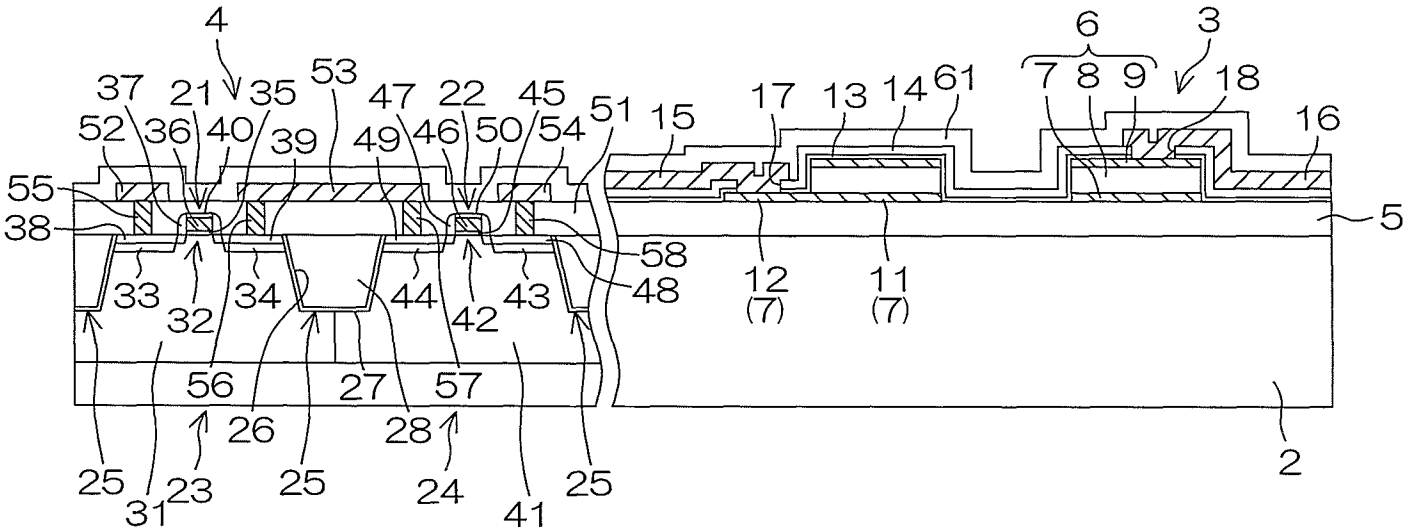
Figure 4S:
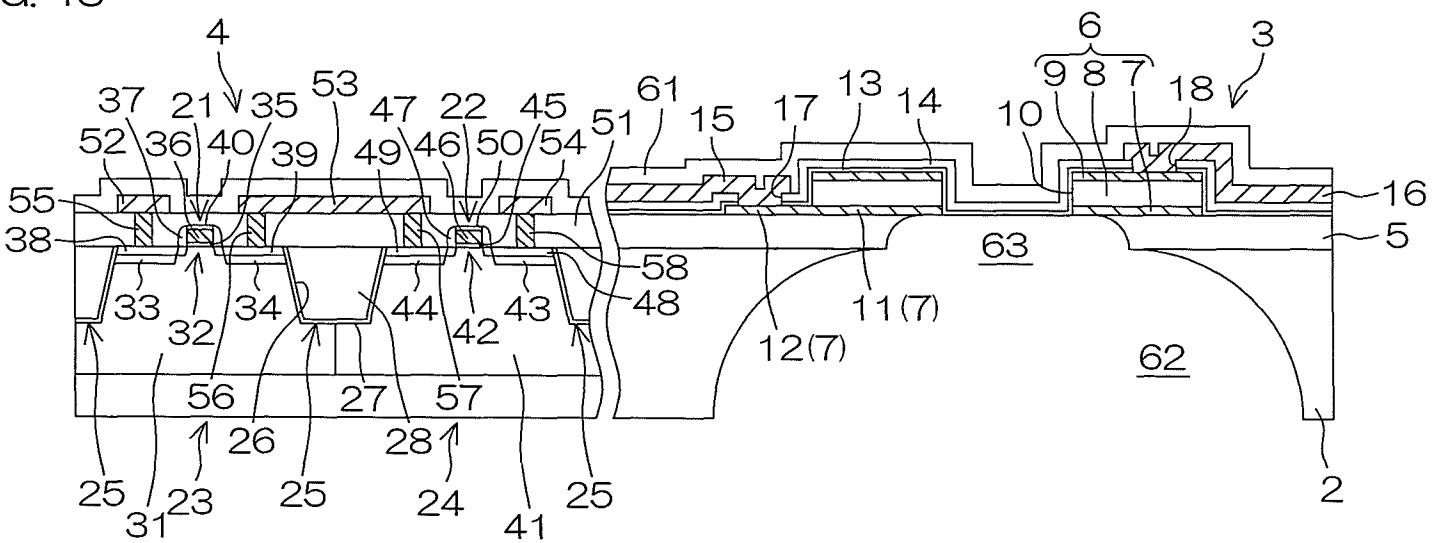

FIGS. 4A to 4S are schematic sectional views showing a sequence of the steps of a production process for the inkjet printer head shown in FIG. 2. In FIGS. 4A to 4S, only electrically conductive portions are hatched, and the other portions are not hatched.

In the production process for the inkjet printer head 1, as shown in FIG. 4A, an oxide film 81 of $SiO_2$ is formed on a front surface of a silicon substrate 2 by a thermal oxidation method or a CVD (Chemical Vapor Deposition) method. In turn, a nitride film 82 of SiN (silicon nitride) is formed by a CVD method. Then, a resist pattern 83 is formed on the nitride film 82 by photolithography. The resist pattern 83 is configured such as to expose only a portion of the silicon substrate 2 to be formed with a trench 26 and cover the other portion of the silicon substrate 2.

Subsequently, as shown in FIG. 4B, the nitride film 82, the oxide film 81 and a surface portion of the silicon substrate 2 are sequentially selectively etched off by using the resist pattern 83 as a mask. As a result, the trench 26 is formed in the surface portion of the silicon substrate 2. After the formation of the trench 26, the resist pattern 83 is removed.

Thereafter, as shown in FIG. 4C, a thermal oxide film 27 is formed in an interior surface of the trench 26 by a thermal oxidation method. In turn, a material for an insulator 28 is deposited on the thermal oxide film 27 and the nitride film 82 by a CVD method. Then, the deposited material and the nitride film 82 are polished by a CMP (Chemical Mechanical Polishing) method. The polishing is continued until a surface of the oxide film 81 is exposed. As a result, the insulator 28 is provided on the thermal oxide film 27. At this time, the insulator 28 is flush with the oxide film 81.

Thereafter, a resist pattern 84 is formed on the insulator 28 and the oxide film 81 by photolithography. The resist pattern 84 is configured such as to cover parts of the insulator 28 and the oxide film 81 present in a region other than a PMOS region 24. Then, an N-type impurity (e.g., P (phosphorus)) is implanted into the PMOS region 24 by an ion implantation method with the use of the resist pattern 84 as a mask. As a result, as shown in FIG. 4D, an N-type well 41 is formed in the PMOS region 24. After the implantation of the N-type impurity, the resist pattern 84 is removed.

Subsequently, a resist pattern 85 is formed on the insulator 28 and the oxide film 81 by photolithography. The resist pattern 85 is configured such as to cover parts of the insulator 28 and the oxide film 81 present in a region other than an NMOS region 23. Then, a P-type impurity (e.g., B (boron)) is implanted into the NMOS region 23 by an ion implantation method with the use of the resist pattern 85 as a mask. As a result, as shown in FIG. 4E, a P-type well 31 is formed in the NMOS region 23. After the implantation of the P-type impurity, the resist pattern 85 is removed.

Thereafter, the oxide film 81 is removed by soft etching. At this time, an upper portion of the insulator 28 is also etched so as to become generally flush with the front surface of the silicon substrate 2. Then, a silicon oxide film 86 is formed over the front surface of the silicon substrate 2 by a thermal oxidation method or a CVD method.

In turn, as shown in FIG. 4F, a polysilicon layer 87 is formed on the silicon oxide film 86 by a CVD method.

Thereafter, as shown in FIG. 4G, a resist pattern 88 is formed on the polysilicon layer 87 by photolithography. The resist pattern 88 is configured such as to cover only portions of the polysilicon layer 87 later serving as gate electrodes 36, 46.

Then, the polysilicon layer 87 is etched to be patterned by using the resist pattern 88 as a mask. Thus, the gate electrodes 36, 46 are formed as shown in FIG. 4H. After the patterning of the polysilicon layer 87, the resist pattern 88 is removed. Thereafter, an N-type impurity is implanted into a surface portion of the P-type well 31 and the gate electrodes 36 by an ion implantation method. Further, a P-type impurity is implanted into a surface portion of the N-type well 41 and the gate electrodes 46 by an ion implantation method.

Subsequently, as shown in FIG. 4I, the silicon oxide film 86 is selectively etched off by using the gate electrodes 36, 46 as a mask, whereby gate insulating films 35, 45 are formed on the silicon substrate 2. Thereafter, SiN is deposited over the silicon substrate 2 by a CVD method. Then, the deposited SiN layer is etched back to form sidewalls 37, 47.

After the formation of the sidewalls 37, 47, as shown in FIG. 4J, an N-type impurity is implanted into the surface portion of the P-type well 31 to a greater depth than the previously implanted N-type impurity by an ion implantation method. Thus, source regions 33 and drain regions 34 are formed. A P-type impurity is implanted into the surface portion of the N-type well 41 to a greater depth than the previously implanted P-type impurity by an ion implantation method. Thus, source regions 43 and drain regions 44 are formed. Thereafter, silicide layers 38, 39, 40, 48, 49, 50 are formed.

Subsequently, as shown in FIG. 4K, a vibration diaphragm 5 and an interlevel insulating film 51 are formed by a CVD method.

Thereafter, as shown in FIG. 4L, a film 89 having the same laminate structure as lower electrodes 7 is formed over the vibration diaphragm 5 and the interlevel insulating film 51. Further, a film 90 of the same material as piezoelectric members 8 is formed over the film 89 by a sputtering method or a sol-gel method. Further, a film 91 having the same laminate structure as upper electrodes 9 is formed over the film 90 by a sputtering method.

Then, as shown in FIG. 4M, a resist pattern 92 is formed on the film 91 as covering portions of the film 91 later serving as the upper electrodes 9 by photolithography.

Subsequently, as shown in FIG. 4N, the film 91 is etched to be patterned by using the resist pattern 92 as a mask. Thus, the upper electrodes 9 are formed. In turn, the film 90 is etched to be patterned. Thus, the piezoelectric members 8 are formed. After the formation of the piezoelectric members 8, the resist pattern 92 is removed. In turn, a new resist pattern (not shown) is formed on the film 89 as covering portions of the film 89 later serving as the lower electrodes 7 by photolithography. Then, the film 89 is etched to be patterned by using the new resist pattern as a mask. Thus, the lower electrodes 7 are formed. After the formation of the lower electrodes 7, the resist pattern is removed.

Thereafter, through-holes are formed in the interlevel insulating film 51 in opposed relation to the source regions 33, 43 and the drain regions 34, 44 as extending thicknesswise through the interlevel insulating film 51 by photolithography and etching. Then, W is supplied into the respective through-holes to completely fill the through-holes by a CVD method. Thus, contact plugs 55 to 58 are formed as shown in FIG. 4O. Thereafter, an alumina film 93 is formed over the resulting silicon substrate 2 by a sputtering method. Further, a silicon oxide film 94 is formed over the alumina film 93 by a CVD method.

Subsequently, as shown in FIG. 4P, the silicon oxide film 94 and the alumina film 93 are selectively removed from the circuit formation region 4, parts of extension portions 12 of the lower electrodes 7 and parts of the upper electrodes 9 by photolithography and etching. Thus, remaining portions of the alumina film 93 and the silicon oxide film 94 respectively serve as a hydrogen barrier film 13 and an interlevel insulating film 14, and through-holes 17, 18 are formed as extending continuously through the hydrogen barrier film 13 and the interlevel insulating film 14.

Thereafter, an Al film is formed on the interlevel insulating films 14, 51 by a sputtering method. Then, the Al film is patterned by photolithography and etching, whereby interconnections 15, 16, 52, 53, 54 are formed as shown in FIG. 4Q.

Thereafter, as shown in FIG. 4R, a surface protective film 61 is formed on the interlevel insulating films 14, 51 by a CVD method.

After the formation of the surface protective film 61, a resist pattern (not shown) is formed on a rear surface of the silicon substrate 2 by photolithography. This resist pattern is configured such as to expose portions of the silicon substrate 2 to be formed with pressure chambers 62 and cover the other portion of the silicon substrate 2. Then, as shown in FIG. 4S, the pressure chambers 62 are formed in the silicon substrate 2 by wet etching with the use of the resist pattern as a mask. Further, an etching liquid capable of etching $SiO_2$ is supplied to the vibration diaphragm 5 through the pressure chambers 62, whereby communication chambers 63 are formed in the vibration diaphragm 5. Thereafter, nozzles 64 are formed as extending continuously through the hydrogen barrier film 13, the interlevel insulating film 14 and the surface protective film 61 by dry-etching from the front surface of the silicon substrate 2. Thus, the inkjet printer head 1 shown in FIG. 2 is produced.

As described above, when the voltage is applied to each of the piezoelectric elements 6 on the vibration diaphragm 5, the vibration diaphragm 5 is deformed together with the piezoelectric element 6. The deformation of the vibration diaphragm 5 pressurizes the ink in the pressure chamber 62 to eject the ink from the nozzle 64 communicating with the pressure chamber 62.

The nozzle 64 is provided in the form of a through-hole which extends through the vibration diaphragm 5. This eliminates the need for a plate provided with nozzles. Therefore, the inkjet printer head 1 is simpler in construction and less costly in production than the conventional piezoelectric inkjet printer head.

Further, the N-channel MOSFETs 21, the P-channel MOSFETs 22 and other semiconductor elements can be formed by utilizing the silicon substrate 2. The interconnections 52, 53, 54, which are provided on the silicon substrate 2 with the intervention of the interlevel insulating film 51, are connected to the N-channel MOSFETs 21 and the P-channel MOSFETs 22 via the contact plugs 55 to 58. Thus, the integrated circuit (control circuit 71) can be incorporated in the inkjet printer head 1.

The driving circuit 72 which applies the voltage to the piezoelectric elements 6 is provided in the silicon substrate 2 provided with the vibration film 5. Therefore, the main body of the inkjet printer head 1 and the driving circuit 72 for the piezoelectric elements 6 can be integrated into a single chip.

Figure 5:
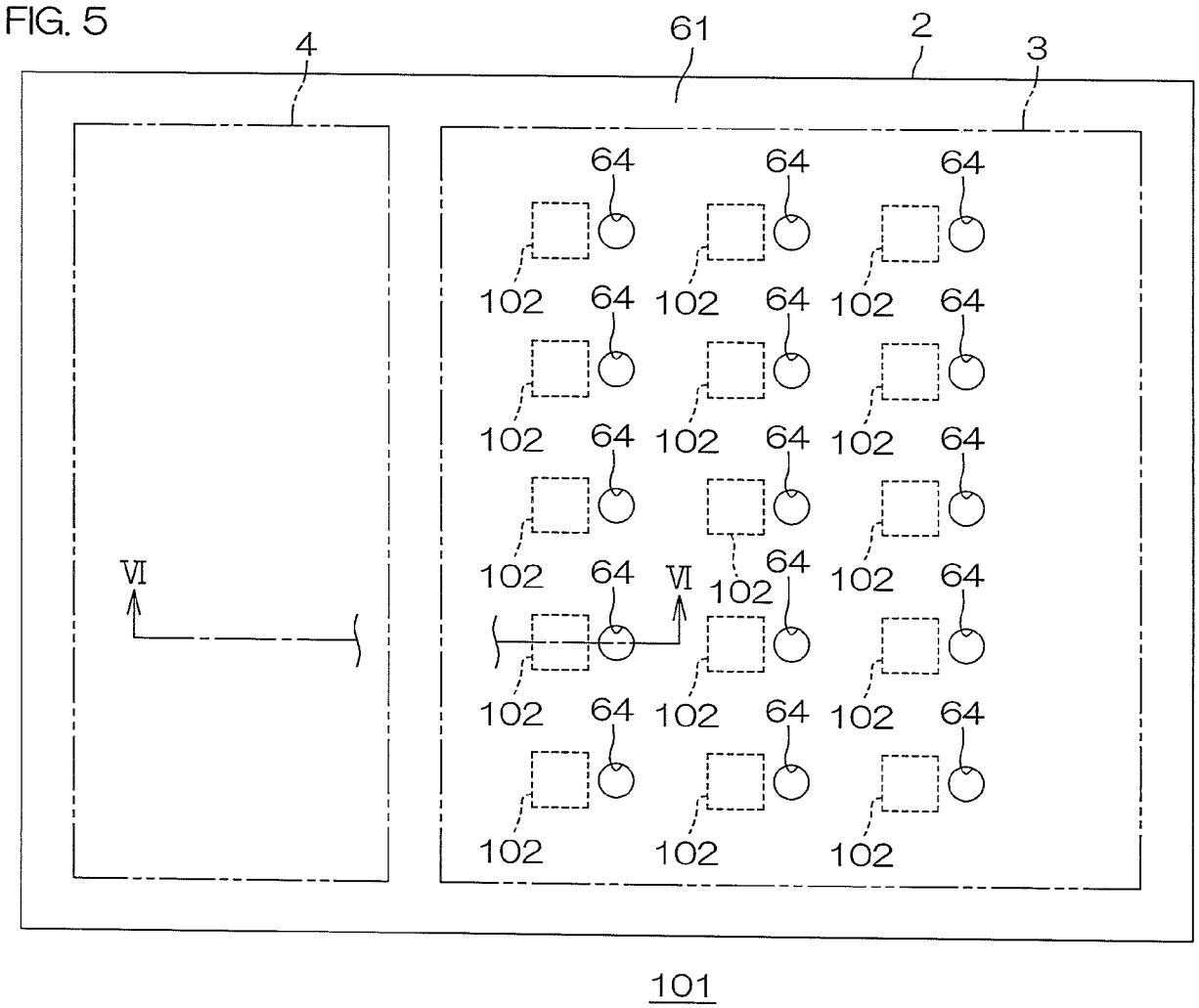
FIG. 5 is a schematic plan view of an inkjet printer head according to a second embodiment of the present invention.
Figure 6:
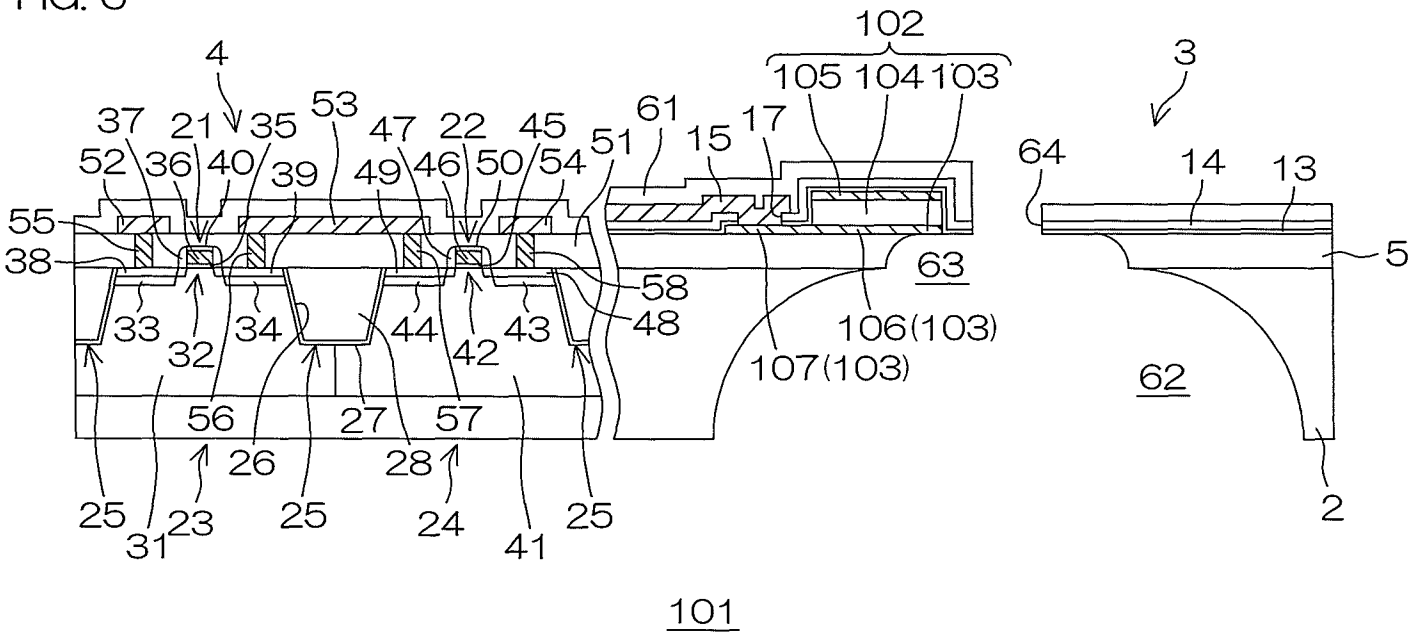
FIG. 6 is a schematic sectional view of the inkjet printer head taken along a section line VI-VI in FIG. 5.

FIG. 5 is a schematic plan view of an inkjet printer head according to a second embodiment of the present invention. FIG. 6 is a schematic sectional view of the inkjet printer head taken along a section line VI-VI in FIG. 5. In FIGS. 5 and 6, components corresponding to those shown in FIGS. 1 and 2 will be denoted by the same reference characters as in FIGS. 1 and 2. Only differences in construction between the inkjet printer head shown in FIGS. 5 and 6 and the inkjet printer head shown in FIGS. 1 and 2 will hereinafter be described, and the components denoted by the same reference characters will not be described. In FIG. 6, only electrically conductive portions are hatched, and the other portions are not hatched.

In the inkjet printer head 1 shown in FIGS. 1 and 2, the piezoelectric elements 6 each have an annular shape to surround the nozzle 64. In the inkjet printer head 101 shown in FIGS. 5 and 6, in contrast, piezoelectric elements 102 each have a generally rectangular plan shape, and are disposed adjacent a nozzle 64. More specifically, the piezoelectric elements 102 are each disposed on a lateral side of the nozzle 64 with respect to a direction parallel to a front surface of a silicon substrate 2.

The piezoelectric elements 102 each include a lower electrode 103, a piezoelectric member 104 provided on the lower electrode 103, and an upper electrode 105 provided on the piezoelectric member 104.

The lower electrode 103 integrally includes a main portion 106 having a rectangular plan shape, and an extension portion 107 linearly extending from the periphery of the main portion 106. The lower electrode 103 has a double layer structure including a Ti layer and a Pt layer stacked in this order from the side of a vibration diaphragm 5.

The piezoelectric member 104 is conformal to the main portion 106 of the lower electrode 103 as seen in plan. The piezoelectric member 104 is formed of PZT.

The upper electrode 105 is conformal to the piezoelectric member 104 as seen in plan. The upper electrode 105 has a double layer structure including an $IrO_2$ layer and an Ir layer stacked in this order from the side of the piezoelectric member 104.

Though not shown in the sectional view of FIG. 6, an interconnection (corresponding to the interconnection 16 in FIG. 2) is connected to the upper electrode 105 through a through-hole extending continuously through a hydrogen barrier film 13 and an interlevel insulating film 14.

The inkjet printer head 101 having the aforesaid construction provides the same effects as the inkjet printer head 1 shown in FIGS. 1 and 2.

Figure 7:
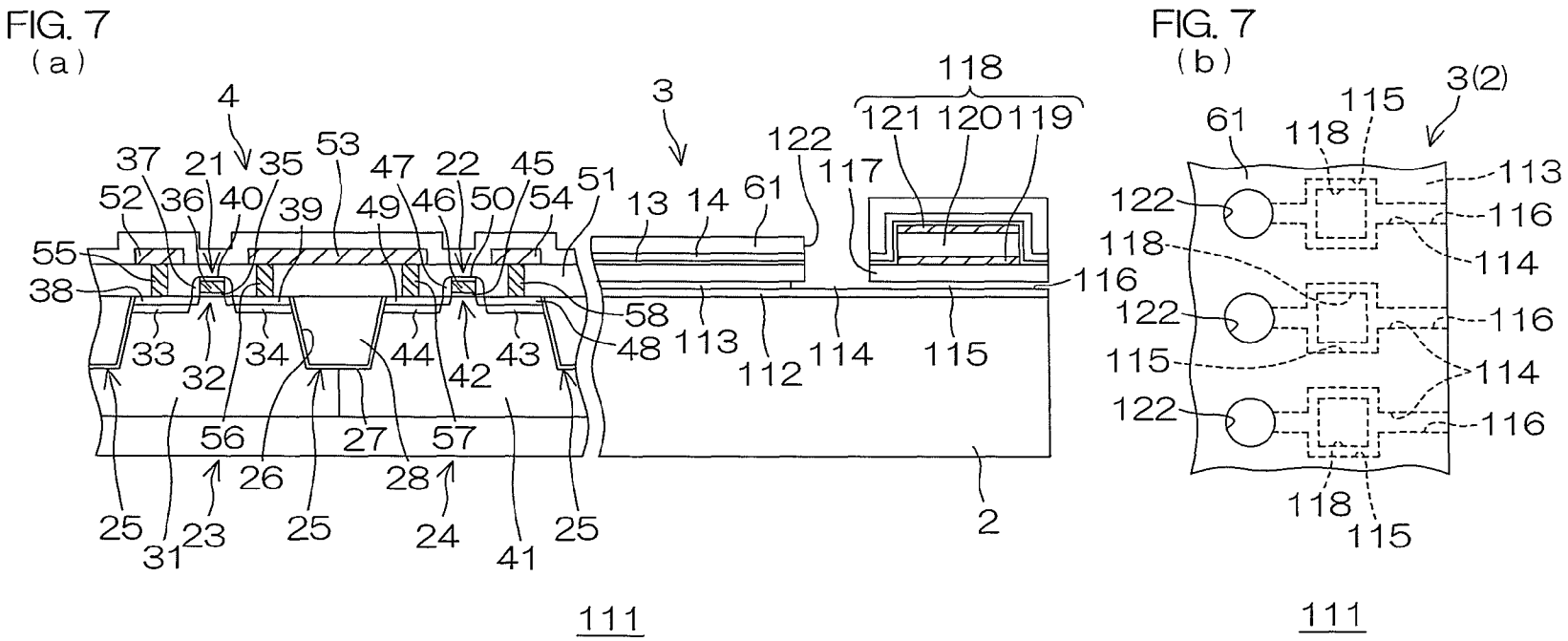
FIG. 7(*a*) is a schematic sectional view of an inkjet printer head according to a third embodiment of the present invention, and FIG. 7(*b*) is a schematic plan view of a major portion of the inkjet printer head according to the third embodiment of the present invention.

FIG. 7(*a*) is a schematic sectional view of an inkjet printer head according to a third embodiment of the present invention, and FIG. 7(*b*) is a schematic plan view of a major portion of the inkjet printer head according to the third embodiment. In FIG. 7(*a*), components corresponding to those shown in FIG. 2 will be denoted by the same reference characters as in FIG. 2. Only differences in construction between the inkjet printer head shown in FIG. 7(*a*) and the inkjet printer head shown in FIG. 2 will hereinafter be described, and the components denoted by the same reference characters will not be described. In FIG. 7(*a*), only electrically conductive portions are hatched, and the other portions are not hatched.

In the inkjet printer head 111 shown in FIG. 7(*a*), a protective film 112 is provided in the entire nozzle formation region 3 on a front surface of a silicon substrate 2. The protective film 112 is formed of $SiO_2$.

A sacrificial layer 113 is provided on the protective film 112. The sacrificial layer 113 is formed of a material, such as SiN or polysilicon, having a proper etching selectivity with respect to the protective film 112 and a vibration diaphragm 117 to be described later.

The sacrificial layer 113 includes a plurality of ink flow passages 114. The ink flow passages 114 each linearly extend from a middle portion of the nozzle formation region 3 away from the circuit formation region 4, and are open in a side surface of the sacrificial layer 113 (see FIG. 7(*b*)). The ink flow passages 114 are arranged equidistantly (see FIG. 7(*b*)). The ink flow passages 114 each have a middle portion having a greater width than the other portion thereof as seen in plan, and the middle portion of the ink flow passage 114 defines a pressure chamber 115. A portion of each of the ink flow passages 114 present between the pressure chamber 115 and the side surface of the sacrificial layer 113 serves as a nozzle 116 for ejecting an ink.

The vibration diaphragm 117 is provided on the sacrificial layer 113. The vibration diaphragm 117 is formed of $SiO_2$. The vibration diaphragm 117 has a thickness of, for example, 0.5 to 2 μm. The pressure chamber 115 is located between the silicon substrate 2 and the vibration diaphragm 117.

A plurality of piezoelectric elements 118 are provided on the vibration diaphragm 117. More specifically, a single piezoelectric element 118 is provided in opposed relation to the pressure chamber 115 provided on the vibration diaphragm 117 (see FIG. 7(*b*)). The piezoelectric elements 118 each include a lower electrode 119, a piezoelectric member 120 provided on the lower electrode 119, and an upper electrode 121 provided on the piezoelectric member 120.

The lower electrode 119 integrally includes a main portion having a rectangular plan shape, and an extension portion (not shown) linearly extending from the periphery of the main portion. The lower electrode 119 has a double layer structure including a Ti layer and a Pt layer stacked in this order from the side of the vibration diaphragm 117.

The piezoelectric member 120 is conformal to the main portion of the lower electrode 119 as seen in plan. The piezoelectric member 120 is formed of PZT.

The upper electrode 121 is conformal to the piezoelectric member 120 as seen in plan. The upper electrode 121 has a double layer structure including an $IrO_2$ layer and an Ir layer stacked in this order from the side of the piezoelectric member 120.

As in the construction shown in FIG. 2, surfaces of the vibration diaphragm 117 and the piezoelectric elements 118 are covered with a hydrogen barrier film 13. An interlevel insulating film 14 is provided on the hydrogen barrier film 13. Though not shown in the sectional view of FIG. 7(*a*), an interconnection (corresponding to the interconnection 15 shown in FIG. 2) is connected to the extension portion of the lower electrode 119 through a through-hole extending continuously through the hydrogen barrier film 13 and the interlevel insulating film 14. Though not shown in the sectional view of FIG. 7(*a*), an interconnection (corresponding to the interconnection 16 shown in FIG. 2) is connected to the upper electrode 121 through a through-hole extending continuously through the hydrogen barrier film 13 and the interlevel insulating film 14. Further, a surface protective film 61 is provided on an outermost surface of the inkjet printer head 111.

Ink supply passages 122 each extend through the hydrogen barrier film 13, the interlevel insulating film 14 and the surface protective film 61 in a portion of the ink flow passage 114 upstream of the pressure chamber 115 with respect to an ink flow direction. An ink tank (not shown) which stores the ink is provided on the surface protective film 61, so that the ink is supplied into the ink flow passages 114 from the ink tank through the ink supply passages 122.

When a voltage is applied to each of the piezoelectric elements 118, a part of the vibration diaphragm 117 facing the corresponding pressure chamber 115 is deformed together with the piezoelectric element 118. The deformation pressurizes the ink in the pressure chamber 115 to eject the ink from the corresponding nozzle 116.

As described above, the nozzle 116 is provided between the protective film 112 on the silicon substrate 2 and the vibration diaphragm 117. This eliminates the need for a plate provided with nozzles. Therefore, the inkjet printer head 111 shown in FIG. 7(*a*) is simpler in construction and less costly in production than the conventional piezoelectric inkjet printer head.

As in the inkjet printer head 1 shown in FIG. 2, N-channel MOSFETs 21, P-channel MOSFETs 22 and other semiconductor elements can be formed by utilizing the silicon substrate 2. Thus, an integrated circuit (control circuit 71) can be produced, which includes the semiconductor elements and interconnections 52 to 54.

Figure 8:
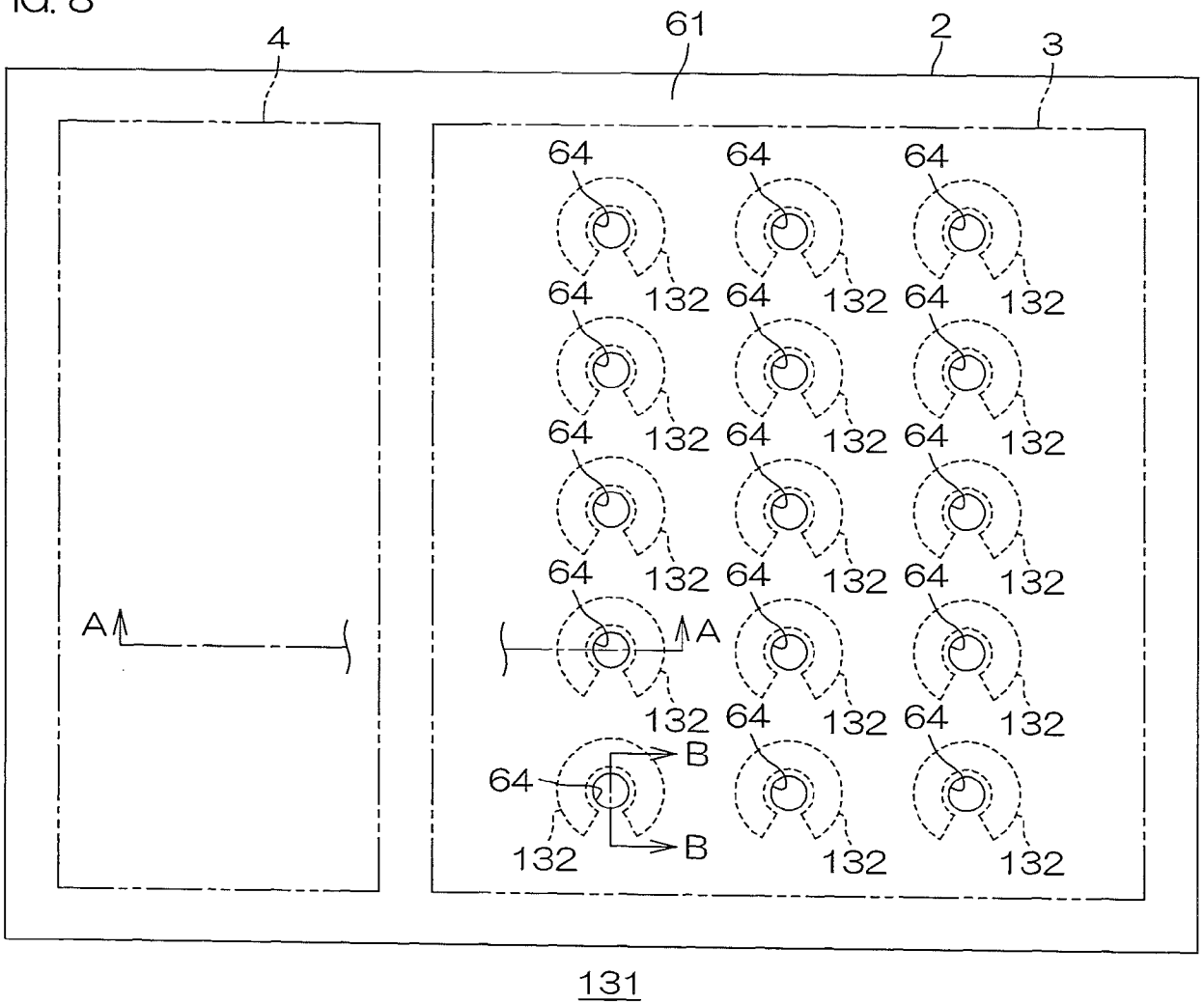
FIG. 8 is a schematic plan view of an inkjet printer head according to a fourth embodiment of the present invention.
Figure 9A:
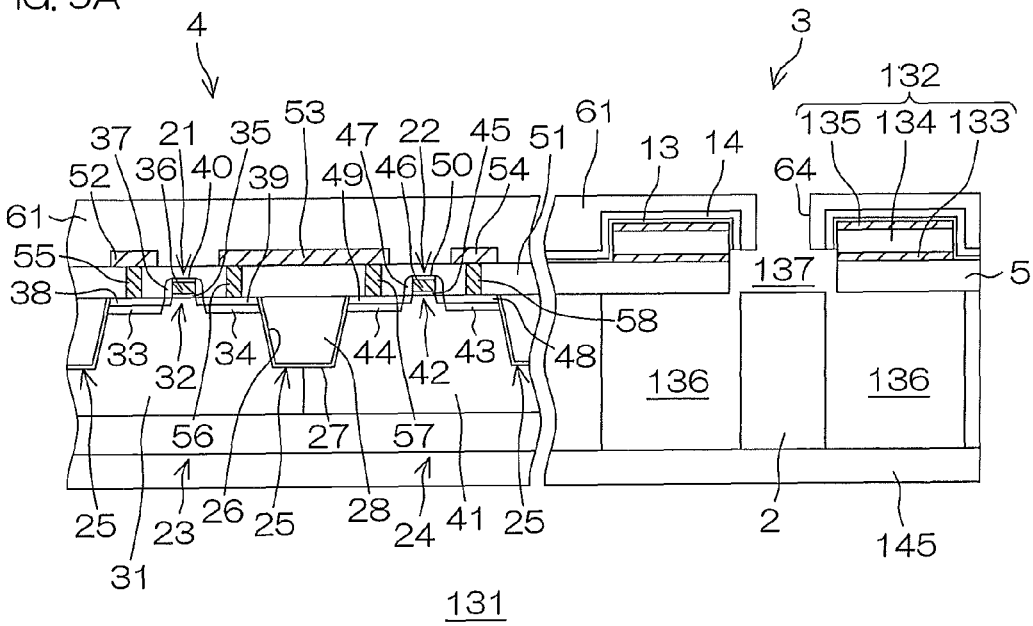
FIG. 9A is a schematic sectional view of the inkjet printer head taken along a section line A-A in FIG. 8.
Figure 9B:
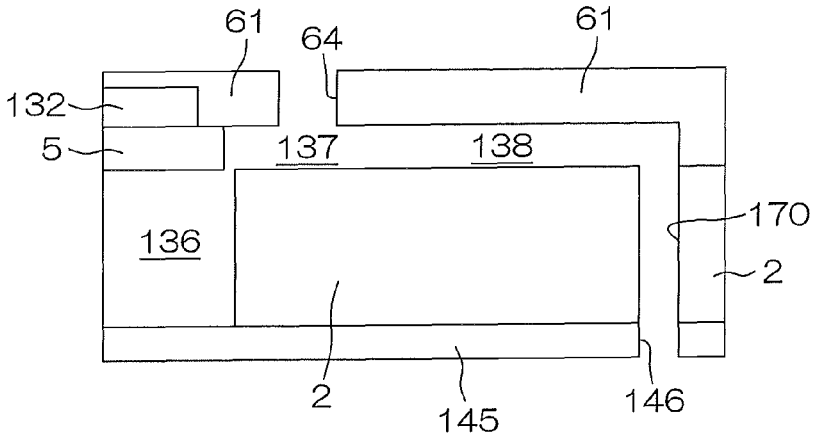
FIG. 9B is a schematic sectional view of the inkjet printer head taken along a section line B-B in FIG. 8.

FIG. 8 is a schematic plan view of an inkjet printer head according to a fourth embodiment of the present invention. FIG. 9A is a schematic sectional view of the inkjet printer head taken along a section line A-A in FIG. 8. FIG. 9B is a schematic sectional view of the inkjet printer head taken along a section line B-B in FIG. 8. In FIGS. 8, 9A and 9B, components corresponding to those shown in FIGS. 1 and 2 will be denoted by the same reference characters as in FIGS. 1 and 2. Only differences in construction between the inkjet printer head shown in FIGS. 8, 9A and 9B and the inkjet printer head shown in FIGS. 1 and 2 will hereinafter be described, and the components denoted by the same reference characters will not be described. In FIGS. 9A and 9B, only electrically conductive portions are hatched, and the other portions are not hatched.

In the inkjet printer head 1 shown in FIGS. 1 and 2, the piezoelectric elements 6 each have an annular shape to surround a nozzle 64. In the inkjet printer head 131 shown in FIGS. 8, 9A and 9B, in contrast, piezoelectric elements 132 are each disposed on a lateral side of a nozzle 64, and have a C-shape (generally annular shape) to surround the nozzle 64.

The piezoelectric elements 132 each include a lower electrode 133, a piezoelectric member 134 provided on the lower electrode 133, and an upper electrode 135 provided on the piezoelectric member 134.

The lower electrode 133 integrally includes a main portion having a C-shape as seen in plan, and an extension portion (not shown) linearly extending from the periphery of the main portion. The lower electrode 133 has a double layer structure including a Ti layer and a Pt layer stacked in this order from the side of a vibration diaphragm 5.

The piezoelectric member 134 is conformal to the main portion of the lower electrode 133 as seen in plan. The piezoelectric member 134 is formed of PZT.

The upper electrode 135 is conformal to the piezoelectric member 134 as seen in plan. The upper electrode 135 has a double layer structure including an $IrO_2$ layer and an Ir layer stacked in this order from the side of the piezoelectric member 134.

Though not shown in the sectional view of FIG. 9A, an interconnection (corresponding to the interconnection 15 shown in FIG. 2) is connected to the extension portion of the lower electrode through a through-hole extending continuously through a hydrogen barrier film 13 and an interlevel insulating film 14. Further, an interconnection (corresponding to the interconnection 16 shown in FIG. 2) is connected to the upper electrode 135 through a through-hole extending continuously through the hydrogen barrier film 13 and the interlevel insulating film 14, though not shown in the sectional view of FIG. 9A.

As shown in FIG. 9A, the silicon substrate 2 includes pressure chambers 136 each extending thicknesswise therethrough in opposed relation to the piezoelectric element 132. The pressure chamber 136 is generally conformal to the piezoelectric element 132 as seen in plan.

The vibration diaphragm 5 includes communication chambers 137 each extending thicknesswise therethrough in vertically opposed relation to a center portion of the C-shaped pressure chamber 136. More specifically, an outer peripheral portion of the communication chamber 137 vertically overlaps an inner peripheral portion of the pressure chamber 136. Thus, the pressure chamber 136 communicates with the communication chamber 137.

A planar closing plate 145 is provided on a rear surface of the silicon substrate 2. The closing plate 145 closes the respective pressure chambers 136 from the rear side of the silicon substrate 2.

As shown in FIG. 9B, the silicon substrate 2 includes ink flow passages 138 each adapted to supply the ink to the nozzle 64 from an ink tank (not shown) attached to a rear surface of the closing plate 145. The ink flow passage 138 extends from the nozzle 64 (communication chamber 137) to the open portion of the "C" shape of the piezoelectric element 132 to be bent downward and further extend thicknesswise through the silicon substrate 2. A portion of the ink flow passage 138 extending through the silicon substrate 2 to be connected to the ink tank (not shown) serves as an ink supply passage 170. The ink supply passage 170 is located separately from the nozzle 64 as seen in plan (as seen in a thickness direction of the silicon substrate 2).

A portion of the ink flow passage 138 excluding the ink supply passage 170 connects the pressure chamber 136 and the ink supply passage 170. The ink supply passage 170 communicates with the pressure chamber 136 through the portion of the ink flow passage 138 excluding the ink supply passage 170. Further, the closing plate 145 has an opening 146 opposed to the ink flow passage 138 (ink supply passage 170). The ink is supplied into the ink flow passage 138 from the ink tank through the opening 146.

The ink supplied into the ink flow passage 138 is further supplied into the pressure chamber 136 through the communication chamber 137 to fill the pressure chamber 136. The ink flow passage 138 permits smooth supply of the ink to the pressure chamber 136 from the ink supply passage 170. The ink supply passage 170 permits stable supply of the ink to the pressure chamber 136 through the ink flow passage 138, so that the pressure chamber 136 can be stably maintained in an ink filled state. When a voltage is applied to each of the piezoelectric elements 132 on the vibration diaphragm 5, the vibration diaphragm 5 is deformed together with the piezoelectric element 132. The deformation of the vibration diaphragm 5 pressurizes the ink in the pressure chamber 136 to eject the ink from the pressure chamber 136 through the communication chamber 137 and the nozzle 64.

FIGS. 10A to 10M are schematic sectional views showing a sequence of the steps of a production process for the inkjet printer head shown in FIG. 9A, the schematic sectional views being each corresponding to the schematic sectional view of FIG. 9A taken along the section line A-A. FIGS. 11A to 11E are schematic sectional views showing some of the steps of the production process for the inkjet printer head shown in FIG. 9B, the schematic sectional views being each corresponding to the schematic sectional view of FIG. 9B taken along the section line B-B. In FIGS. 10A to 10M and FIGS. 11A to 11E, only electrically conductive portions are hatched, and the other portions are not hatched.

Figure 10A:
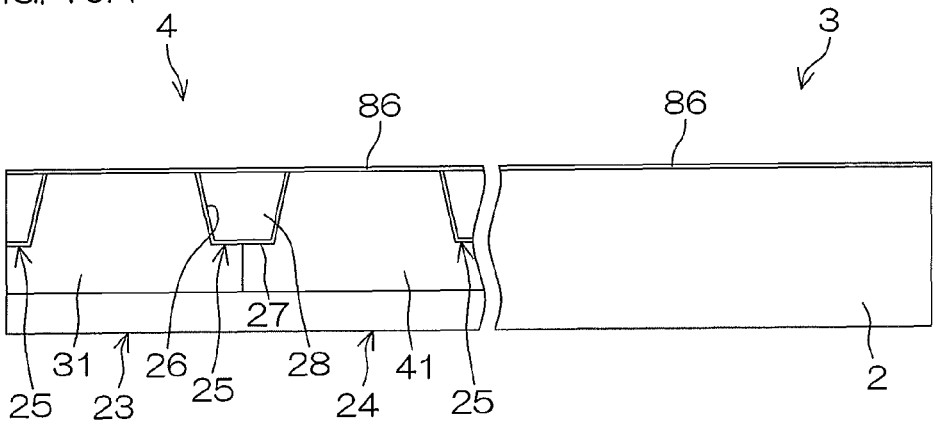
FIGS. 10A to 10M are schematic sectional views for explaining a process for producing the inkjet printer head shown in FIG. 9A, the schematic sectional views being corresponding to the schematic sectional view of FIG. 9A taken along the section line A-A.
Figure 11A:
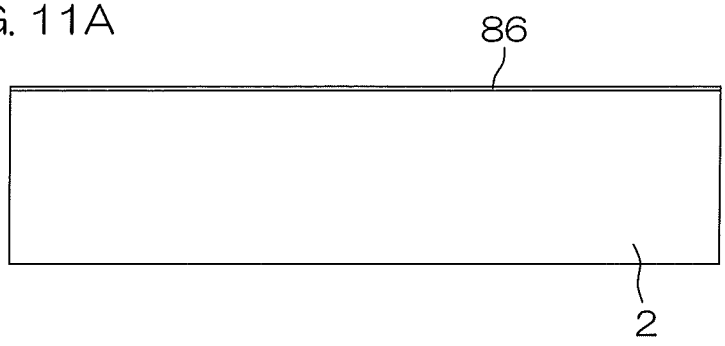
FIGS. 11A to 11E are schematic sectional views for explaining the process for producing the inkjet printer head shown in FIG. 9B, the schematic sectional views being corresponding to the schematic sectional view of FIG. 9B taken along the section line B-B.

As shown in FIGS. 10A and 11A, a silicon oxide film 86 is formed over a front surface of the silicon substrate 2 in the same manner as in the steps shown in FIGS. 4A to 4E.

Figure 10B:
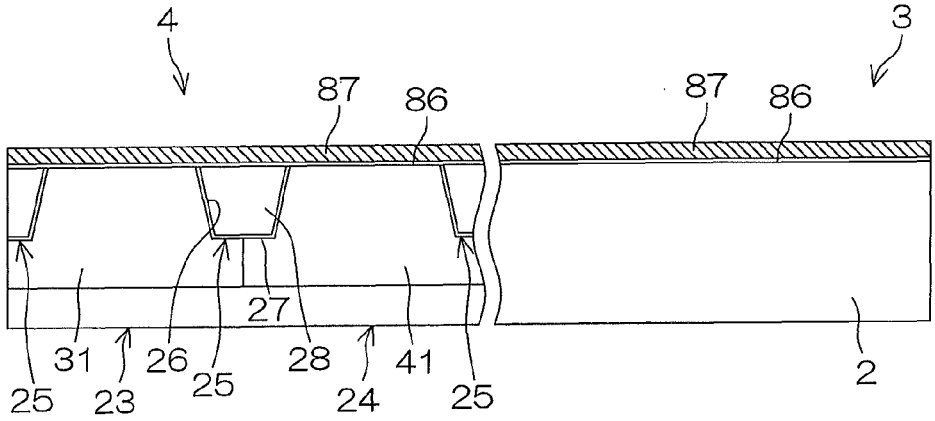
Figure 11B:
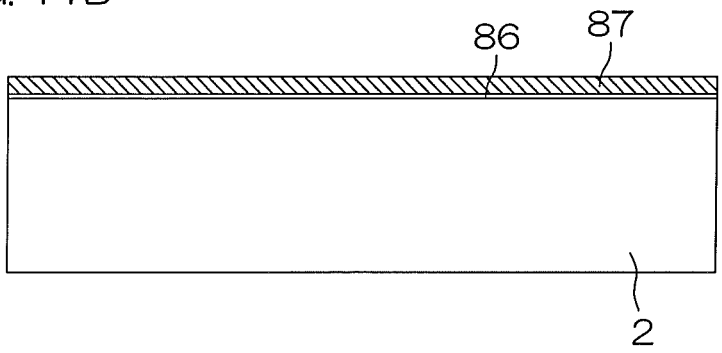

In turn, as shown in FIGS. 10B and 11B, a polysilicon layer 87 is formed on the silicon oxide film 86 by a CVD method.

Figure 10C:
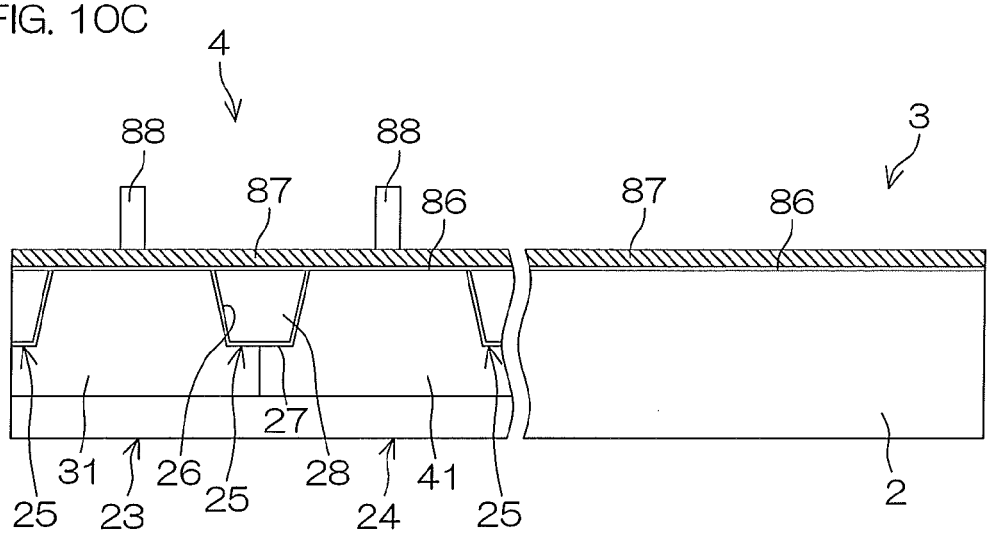
Figure 11C:
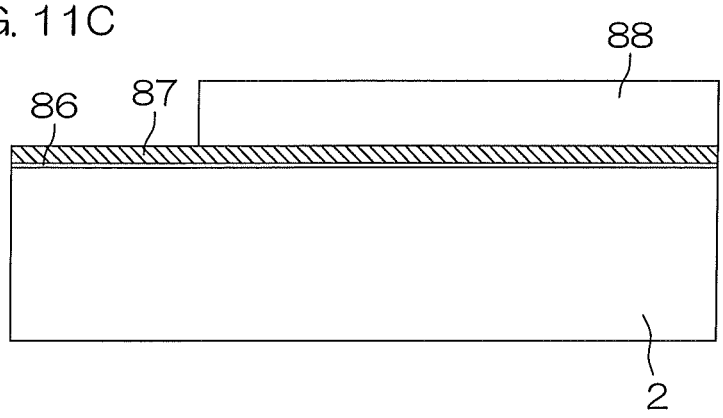

Thereafter, as shown in FIGS. 10C and 11C, a resist pattern 88 is formed on the polysilicon layer 87 by photolithography. The resist pattern 88 is configured such as to cover portions of the polysilicon layer 87 later serving as gate electrodes 36, 46 and portions of the polysilicon layer 87 to be formed with communication chambers 137 and ink flow passages 138.

Figure 10D:
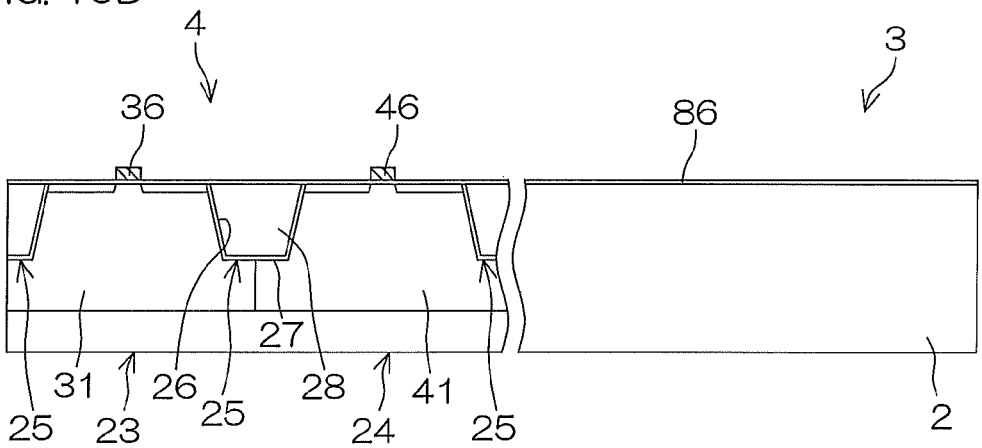
Figure 11D:
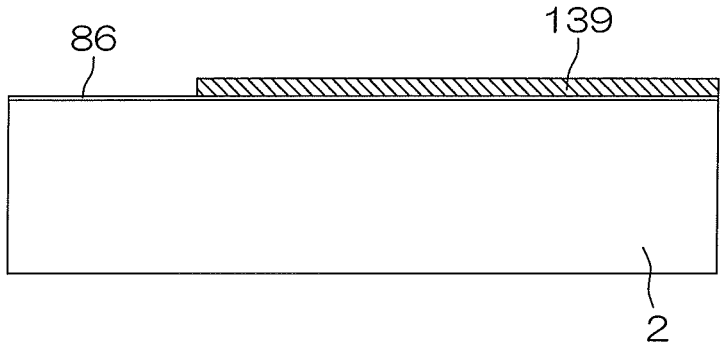

Then, the polysilicon layer 87 is etched to be patterned by using the resist pattern 88 as a mask. Thus, the gate electrodes 36, 46 are formed as shown in FIG. 10D, and a sacrificial film 139 is formed, as shown in FIG. 11D, in which the communication chambers 137 and the ink flow passages 138 are later formed. After the patterning of the polysilicon layer 87, the resist pattern 88 is removed. Thereafter, an N-type impurity is implanted into a surface portion of a P-type well 31 and the gate electrodes 36 by an ion plantation method. Further, a P-type impurity is implanted into a surface portion of an N-type well 41 and the gate electrodes 46 by an ion implantation method.

Figure 10E:
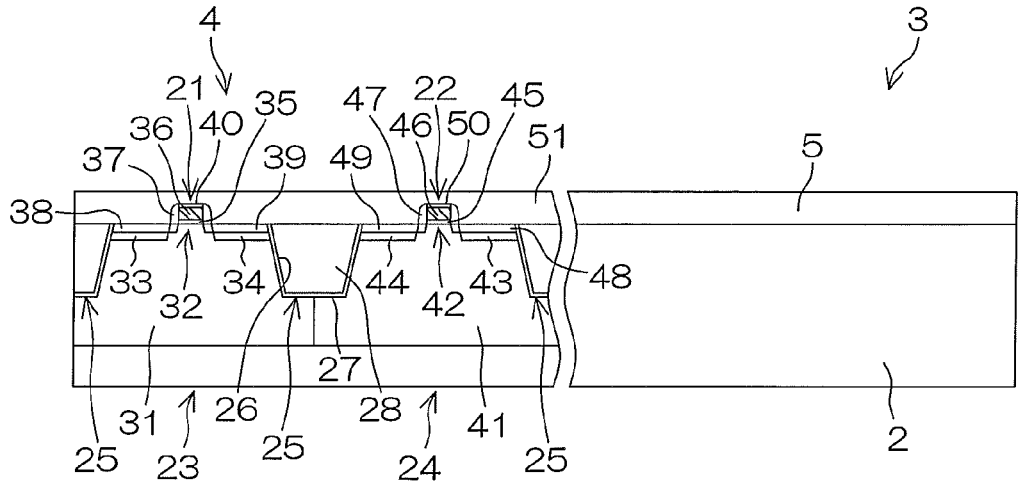
Figure 11E:
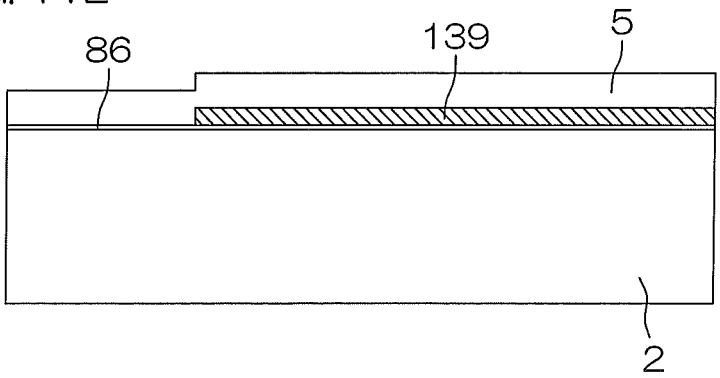

Thereafter, gate insulating films 35, 45, sidewalls 37, 47 and silicide layers 38, 39, 40, 48, 49, 50 are formed in a circuit formation region 4 in the same manner as in the steps shown in FIGS. 4I and 4J. Then, as shown in FIGS. 10E and 11E, a vibration diaphragm 5 and an interlevel insulating film 51 are formed in the same manner as in the step shown in FIG. 4K.

Figure 10F:
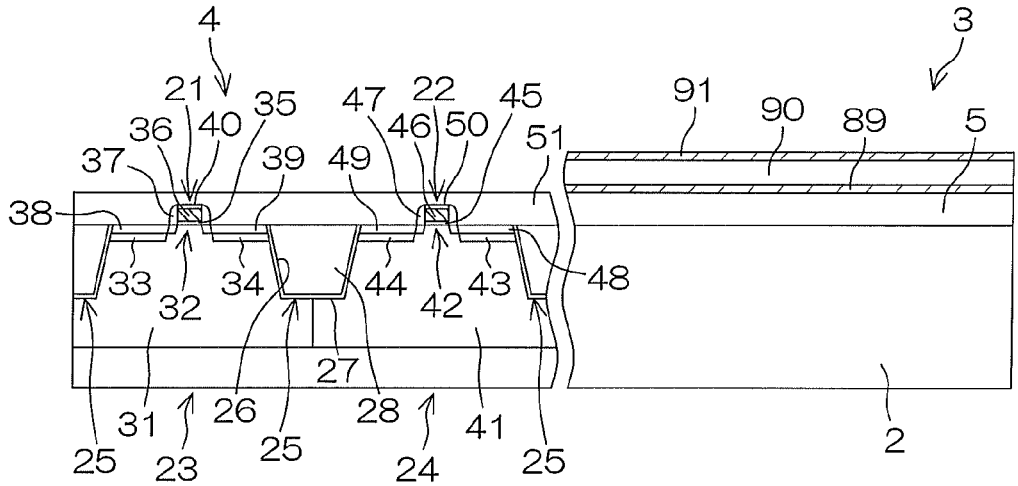

Thereafter, as shown in FIG. 10F, a film 89 having the same laminate structure as lower electrodes 133 is formed over the vibration diaphragm 5. Further, a film 90 of the same material as the piezoelectric members 134 is formed over the film 89 by a sputtering method or a sol-gel method. A film 91 having the same laminate structure as upper electrodes 135 is formed over the film 90 by a sputtering method.

Figure 10G:
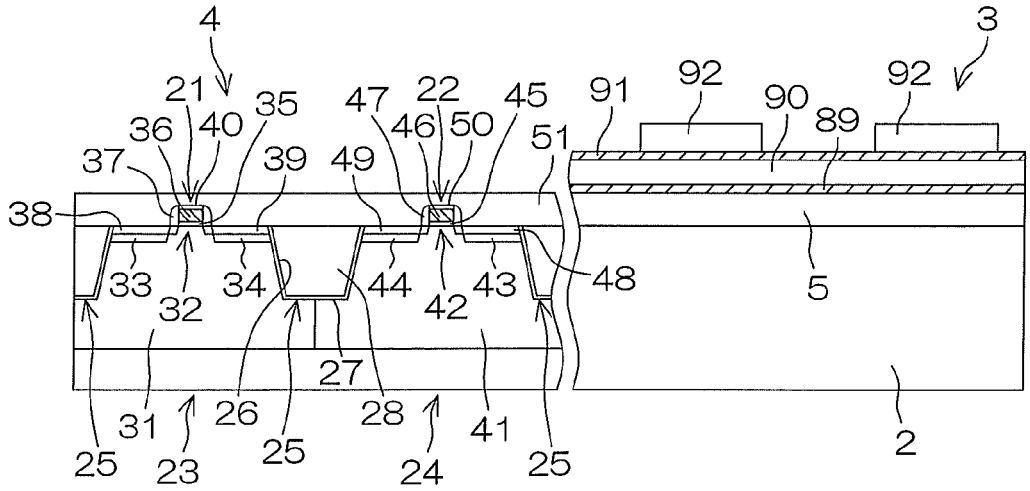

In turn, as shown in FIG. 10G, a resist pattern 92 is formed on the film 91 as covering portions of the film 91 later serving as the upper electrodes 135 by photolithography.

Figure 10H:
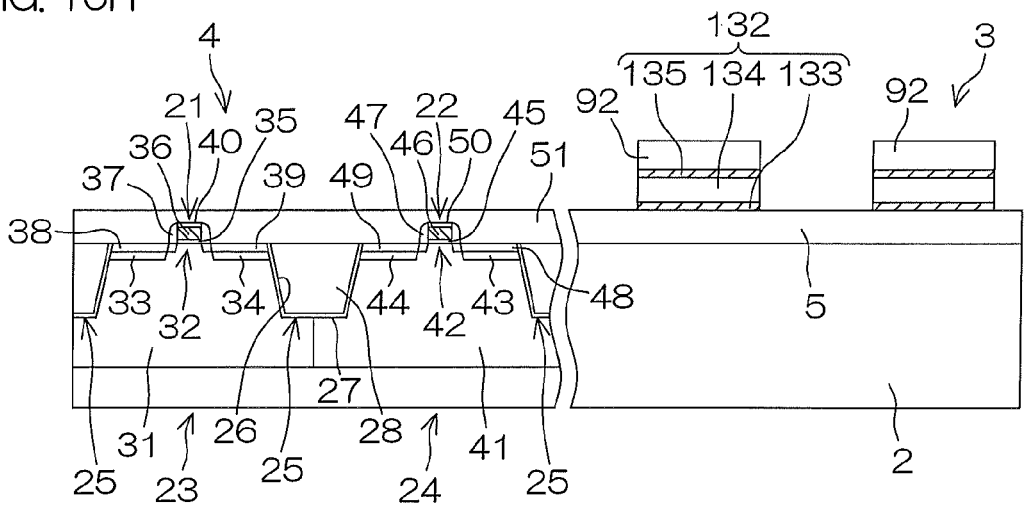
Figure 10I:
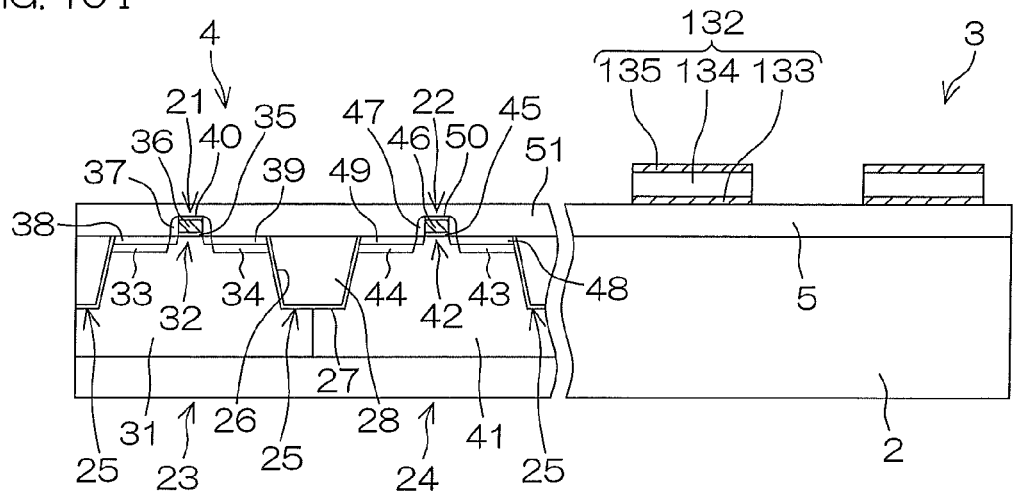

Thereafter, as shown in FIG. 10H, the film 91 is etched to be patterned by using the resist pattern 92 as a mask, whereby the upper electrodes 135 are formed. In turn, the film 90 is etched to be patterned, whereby the piezoelectric members 134 are formed. Further, the film 89 is etched to be patterned, whereby the lower electrodes 133 are formed. After the formation of the lower electrodes 133, as shown in FIG. 10I, the resist pattern 92 is removed.

Figure 10J:
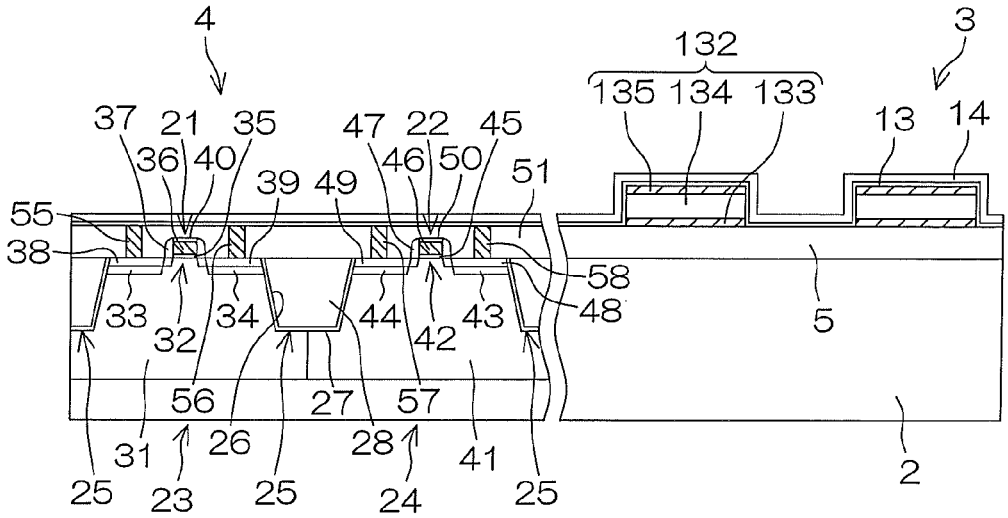

Thereafter, as shown in FIG. 10J, a hydrogen barrier film 13 is formed over the resulting silicon substrate 2 by a sputtering method. Further, an interlevel insulating film 14 is formed over the hydrogen barrier film 13 by a CVD method.

Figure 10K:
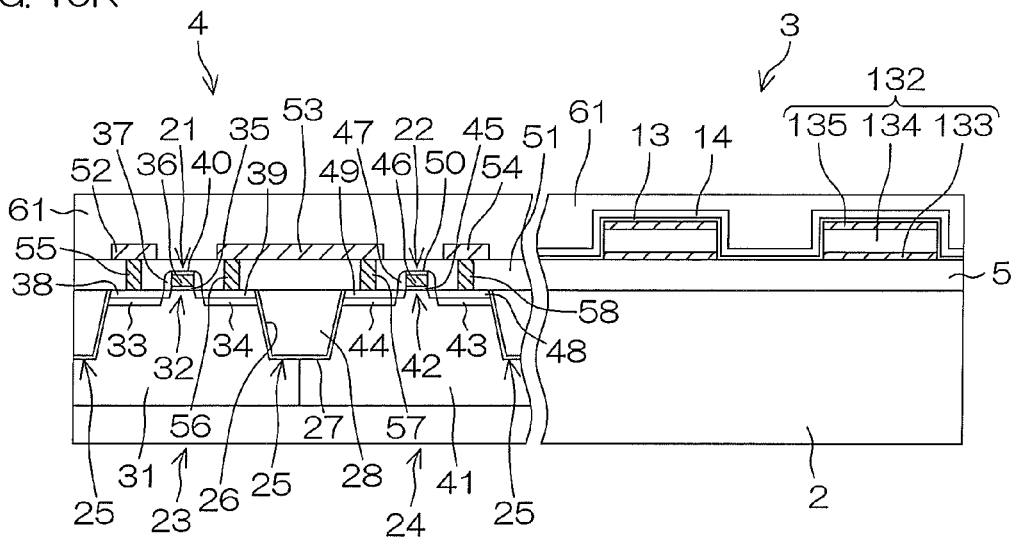

In the circuit formation region 4, contact plugs 55 to 58 are formed as extending through the interlevel insulating film 51, and interconnections 52 to 54 are formed in the same manner as in the steps shown in FIGS. 4O, 4P and 4Q. Then, as shown in FIG. 10K, a surface protective film 61 is formed on the interlevel insulating film 14 in the same manner as in the step shown in FIG. 4R. An upper surface of the surface protective film 61 may be planarized.

Figure 10L:
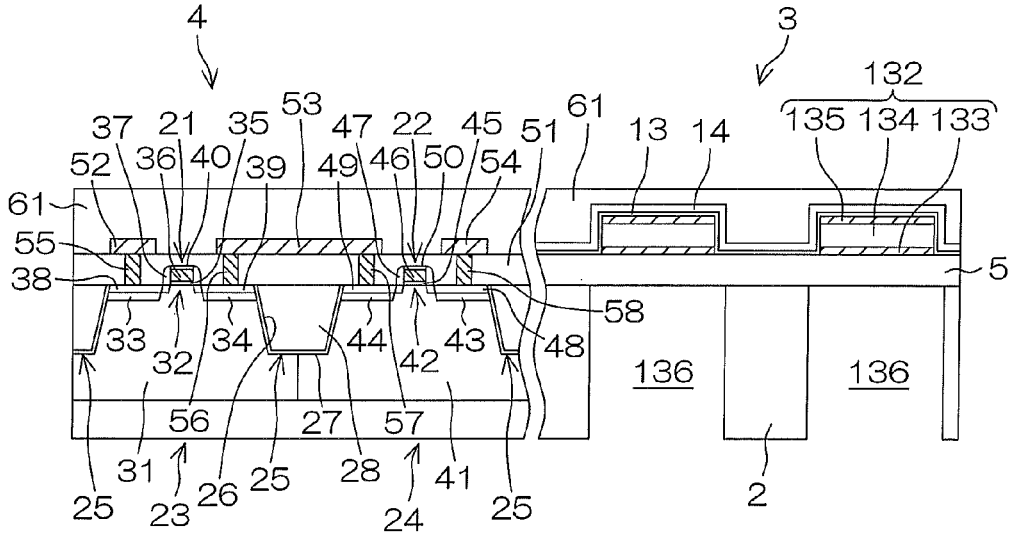

Subsequently, as shown in FIG. 10L, the silicon substrate 2 is etched from its rear side by a photolithography/etching process, whereby pressure chambers 136 are formed in the silicon substrate 2.

Figure 10M:
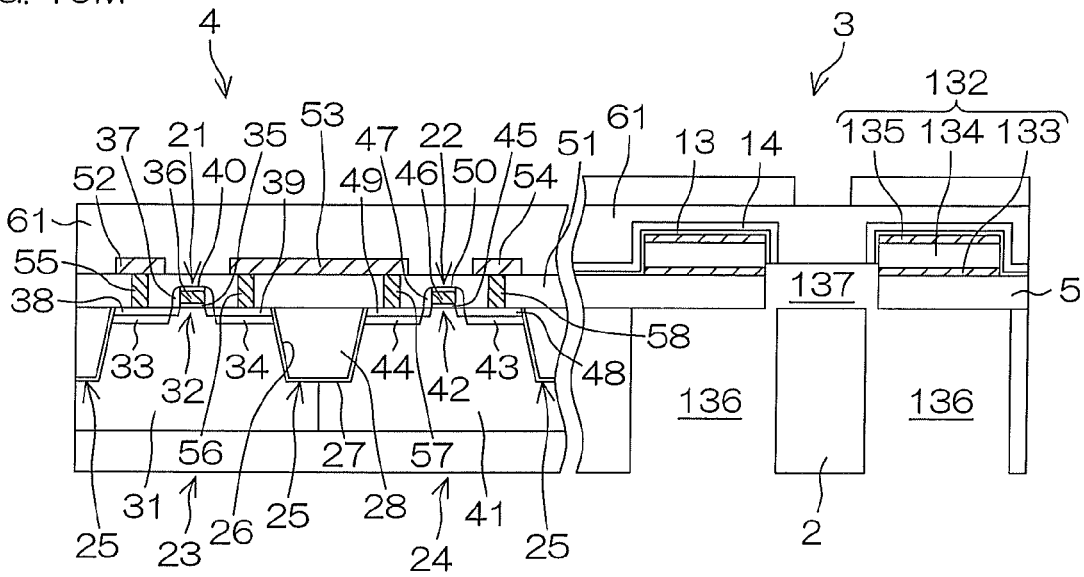

Further, as shown in FIG. 10M, an etching liquid capable of etching polysilicon is supplied to the sacrificial layer 139 (see FIG. 11E) through the pressure chambers 136 to remove the sacrificial layer 139. Thus, communication chambers 137 and ink flow passages 138 are formed (see FIG. 9B). Thereafter, the silicon substrate 2 is dry-etched from its front side, whereby nozzles 64 are formed as extending through the hydrogen barrier film 13, the interlevel insulating film 14 and the surface protective film 61. Thus, the inkjet printer head 131 shown in FIGS. 9A and 9B is produced.

The inkjet printer head 131 having the aforesaid construction also provides the same effects as the inkjet printer head 1 shown in FIGS. 1 and 2.

Figure 12:
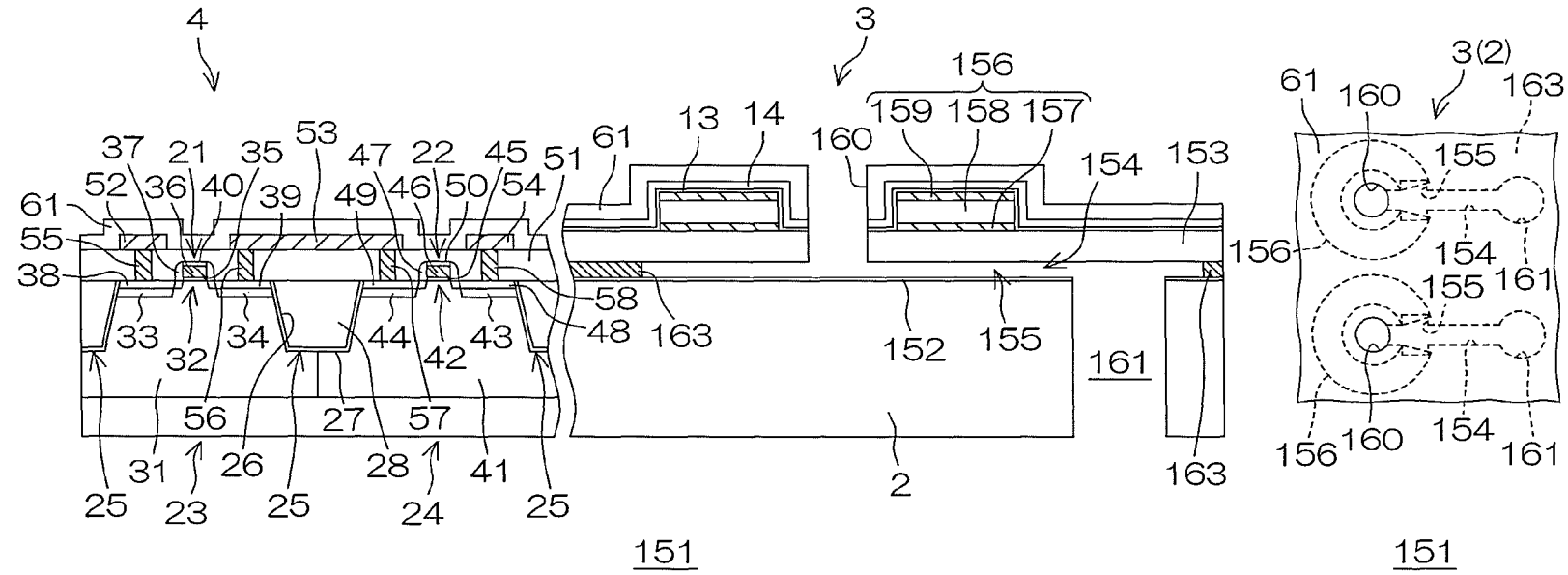
FIG. 12(*a*) is a schematic sectional view of an inkjet printer head according to a fifth embodiment of the present invention, and FIG. 12(*b*) is a schematic plan view of a major portion of the inkjet printer head according to the fifth embodiment of the present invention.

FIG. 12(*a*) is a schematic sectional view of an inkjet printer head according to a fifth embodiment of the present invention, and FIG. 12(*b*) is a schematic plan view of a major portion of the inkjet printer head according to the fifth embodiment of the present invention. In FIG. 12(*a*), components corresponding to those shown in FIG. 2 will be denoted by the same reference characters as in FIG. 2. Only differences in construction between the inkjet printer head shown in FIG. 12(*a*) and the inkjet printer head shown in FIG. 2 will hereinafter be described, and the components denoted by the same reference characters will not be described. In FIG. 12(*a*), only electrically conductive portions are hatched, and the other portions are not hatched.

In the inkjet printer head 151 shown in FIG. 12(*a*), a protective film 152 is provided in the entire nozzle formation region 3 on a front surface of a silicon substrate 2. The protective film 152 is formed of $SiO_2$.

A sacrificial layer 163 is provided on the protective film 152. The sacrificial layer 163 is formed of a material, such as SiN or polysilicon, having a proper etching selectivity with respect to the protective film 152 and a vibration diaphragm 153 to be described later.

A plurality of ink flow passages 154 are provided in the sacrificial layer 163. The ink flow passages 154 linearly extend from a middle portion of the nozzle formation region 3 (see FIG. 12(*b*)). The ink flow passages 154 are arranged equidistantly (see FIG. 12(*b*)). The ink flow passages 154 each have a middle portion having a greater width than the other portion thereof as seen in plan, and pressure chambers 155 are each defined by the middle portion of the ink flow passage 154.

The vibration diaphragm 153 is provided on the sacrificial layer 163. The vibration diaphragm 153 is formed of $SiO_2$. The vibration diaphragm 153 has a thickness of, for example, 0.5 to 2 μm. The pressure chambers 155 are disposed between the silicon substrate 2 and the vibration diaphragm 153.

A plurality of piezoelectric elements 156 are provided on the vibration diaphragm 153. More specifically, the piezoelectric elements 156 are respectively opposed to the pressure chambers 155 provided on the vibration diaphragm 153 (see FIG. 12(*b*)). The piezoelectric elements 156 each include a lower electrode 157, a piezoelectric member 158 provided on the lower electrode 157, and an upper electrode 159 provided on the piezoelectric member 158.

The lower electrode 157 integrally includes a main portion having a C-shape that is open in the extending direction of the ink flow passage 154 as seen in plan, and an extension portion (not shown) linearly extending from the periphery of the main portion. The lower electrode 157 has a double layer structure including a Ti layer and a Pt layer stacked in this order from the side of the vibration diaphragm 153.

The piezoelectric member 158 is conformal to the main portion of the lower electrode 157 as seen in plan. The piezoelectric member 158 is formed of PZT.

The upper electrode 159 is conformal to the piezoelectric member 158 as seen in plan. The upper electrode 159 has a double layer structure including an $IrO_2$ layer and an Ir layer stacked in this order from the side of the piezoelectric member 158.

As in the construction shown in FIG. 2, surfaces of the vibration diaphragm 153 and the piezoelectric elements 156 are covered with a hydrogen barrier film 13. An interlevel insulating film 14 is provided on the hydrogen barrier film 13. Though not shown in the sectional view of FIG. 12(*a*), an interconnection (corresponding to the interconnection 15 shown in FIG. 2) is connected to the extension portion of the lower electrode 157 through a through-hole extending continuously through the hydrogen barrier film 13 and the interlevel insulating film 14. Though not shown in the sectional view of FIG. 12(*a*), an interconnection (corresponding to the interconnection 16 shown in FIG. 2) is connected to the upper electrode 159 through a through-hole extending continuously through the hydrogen barrier film 13 and the interlevel insulating film 14. Further, a surface protective film 61 is provided on an outermost surface of the inkjet printer head 151.

A nozzle 160 is provided in a center portion of each of the C-shaped piezoelectric elements 156. In other words, the piezoelectric elements 156 are each disposed on a lateral side of the nozzle 160, and each have a generally annular shape to surround the nozzle 160. The nozzle 160 extends through the surface protective film 61, the interlevel insulating film 14 and the hydrogen barrier film 13 in a stacking direction to communicate with the pressure chamber 155.

An ink supply passage 161, which is defined by a portion of the ink flow passage 154 upstream of the pressure chamber 155 with respect to an ink flow direction, extends thicknesswise through the silicon substrate 2. The ink supply passage 161 is located separately from the nozzle 160 as seen in plan. Therefore, it is possible to provide the pressure chamber 155 between the ink supply passage 161 and the nozzle 160 as seen in plan.

The ink flow passage 154 connects the pressure chamber 155 and the ink supply passage 161. The ink supply passage 161 communicates with the pressure chamber 155 via the ink supply passage 154. An ink tank (not shown) which stores the ink is provided on a rear surface of the silicon substrate 2, so that the ink is supplied into the ink flow passage 154 from the ink tank through the ink supply passage 161. The ink flow passage 154 permits smooth supply of the ink from the ink supply passage 161 into the pressure chamber 155, so that the pressure chamber 155 can be stably maintained in an ink filled state.

When a voltage is applied to each of the piezoelectric elements 156, a part of the vibration diaphragm 153 facing the corresponding pressure chamber 155 is deformed together with the piezoelectric element 156. The deformation pressurizes the ink in the pressure chamber 155 to eject the ink from the corresponding nozzle 160.

FIGS. 13A to 13H are schematic sectional views showing a sequence of the steps of a production process for the inkjet printer head shown in FIG. 12. In FIGS. 13A to 13H, only electrically conductive portions are hatched, and the other portions are not hatched.

After a polysilicon layer 87 is formed on a silicon oxide film 86 in the same manner as in the steps shown in FIGS. 4A to 4F, the polysilicon layer 87 is patterned in the same manner as in the steps shown in FIGS. 4G and 4H. At this time, parts of the silicon oxide film 86 and the polysilicon layer 87 present in a nozzle formation region 3 remain.

Figure 13A:
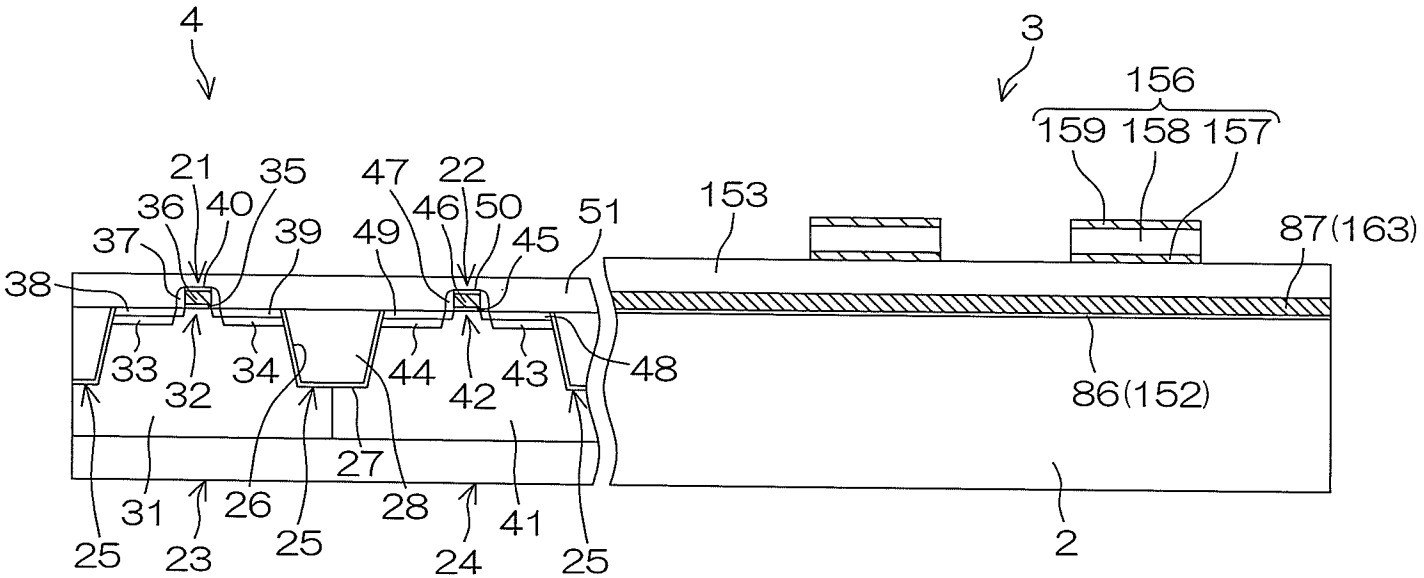
FIGS. 13A to 13H are schematic sectional views for explaining a process for producing the inkjet printer head shown in FIG. 12.

Thereafter, as shown in FIG. 13A, a vibration diaphragm 153 and an interlevel insulating film 51 are formed in the same manner as in the steps shown in FIGS. 4I to 4K. Then, lower electrodes 157, piezoelectric members 158 and upper electrodes 159 are formed on the vibration diaphragm 153. The parts of the silicon oxide film 86 and the polysilicon layer 87 remaining in the nozzle formation region 3 respectively serve as a protective film 152 and a sacrificial layer 163 shown in FIG. 12(*a*).

Figure 13B:
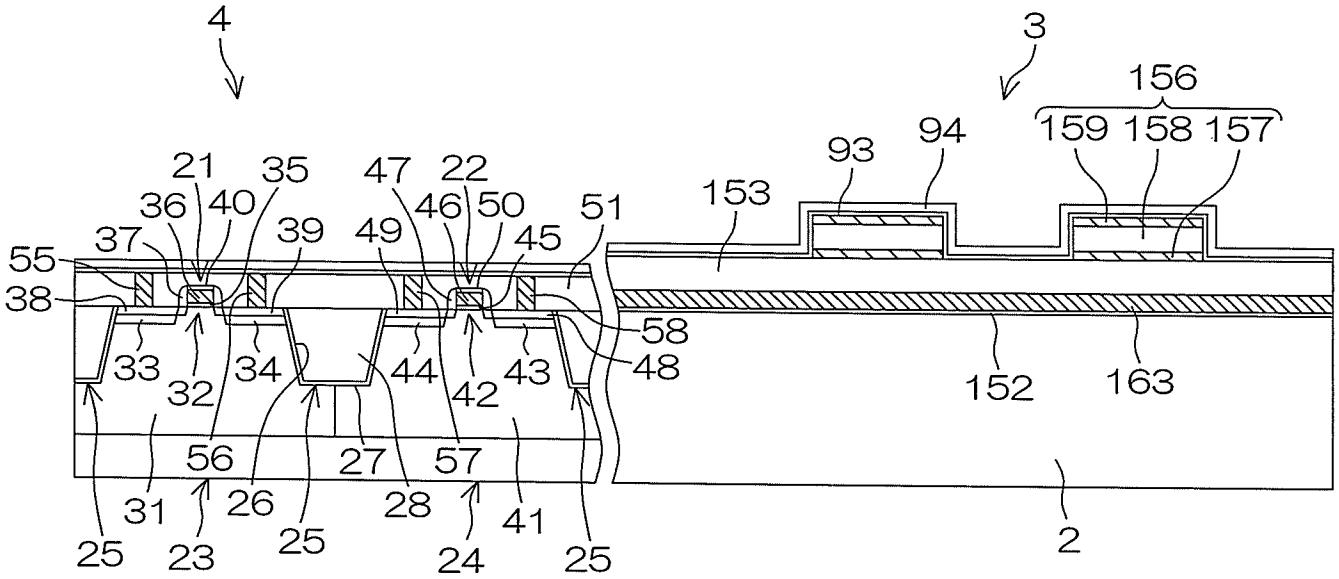

Subsequently, as shown in FIG. 13B, an alumina film 93 is formed over the resulting silicon substrate 2 by a sputtering method. Further, a silicon oxide film 94 is formed over the alumina film 93 by a CVD method.

Figure 13C:
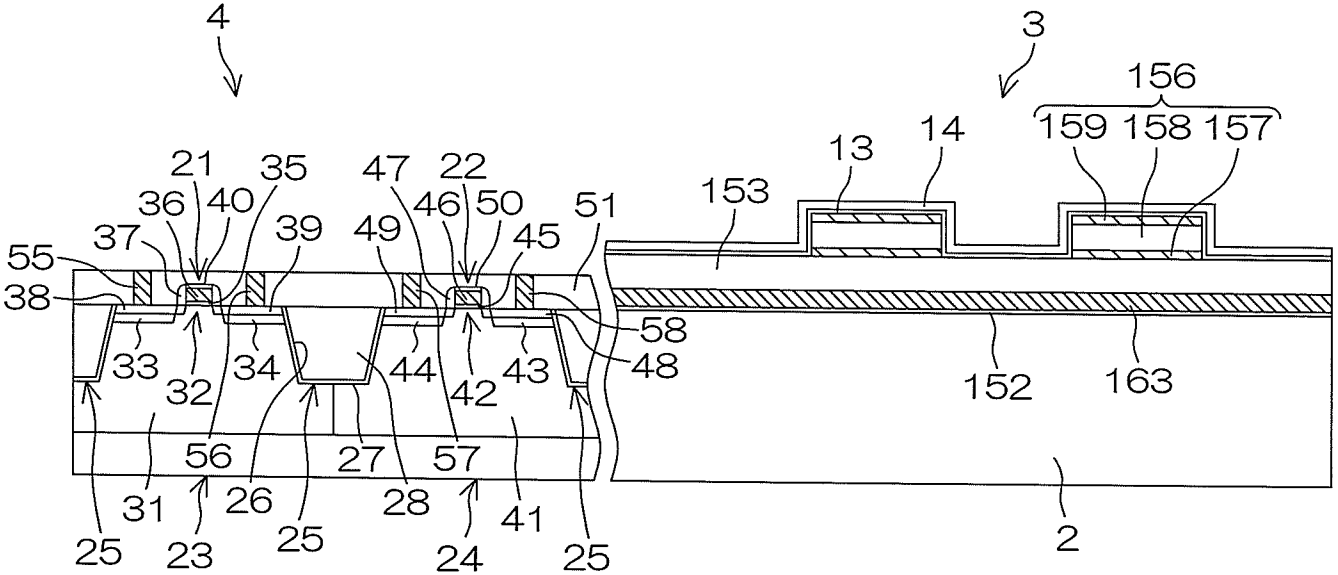

In turn, as shown in FIG. 13C, parts of the silicon oxide film 94 and the alumina film 93 present in a circuit formation region 4 are removed by photolithography and etching. Thus, remaining parts of the alumina film 93 and the silicon oxide film 94 respectively serve as a hydrogen barrier film 13 and an interlevel insulating film 14.

Figure 13D:
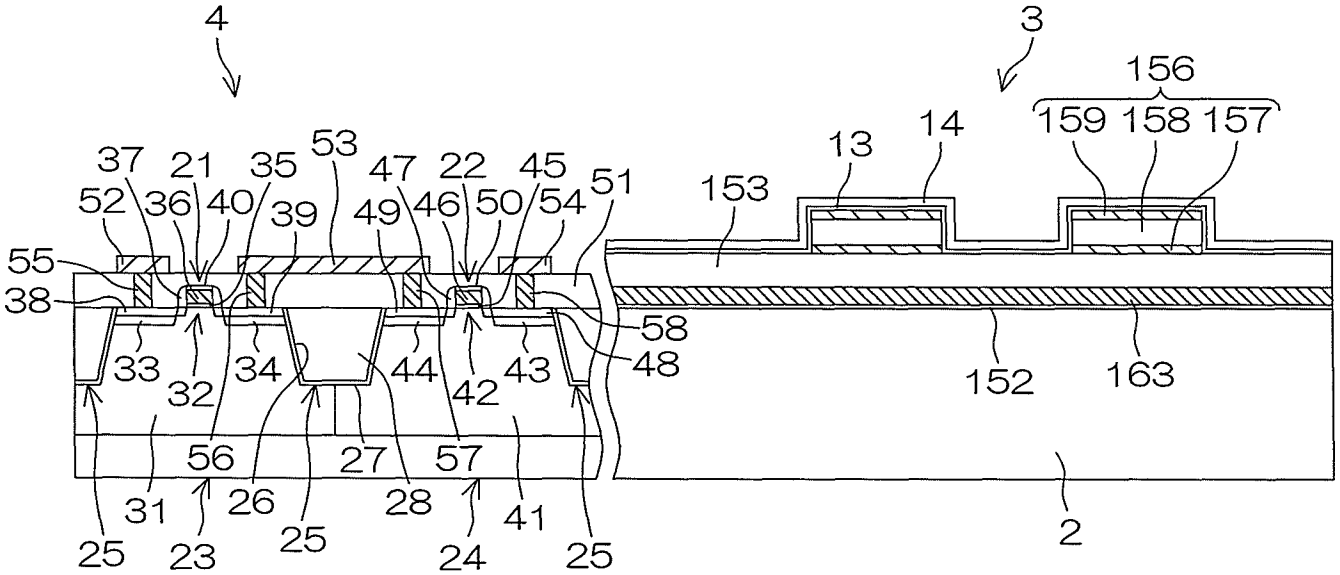

Thereafter, an Al film is formed on the interlevel insulating film 51 by a sputtering method. Then, the Al film is patterned by photolithography and etching, whereby interconnections 52, 53, 54 are formed as shown in FIG. 13D.

Figure 13E:
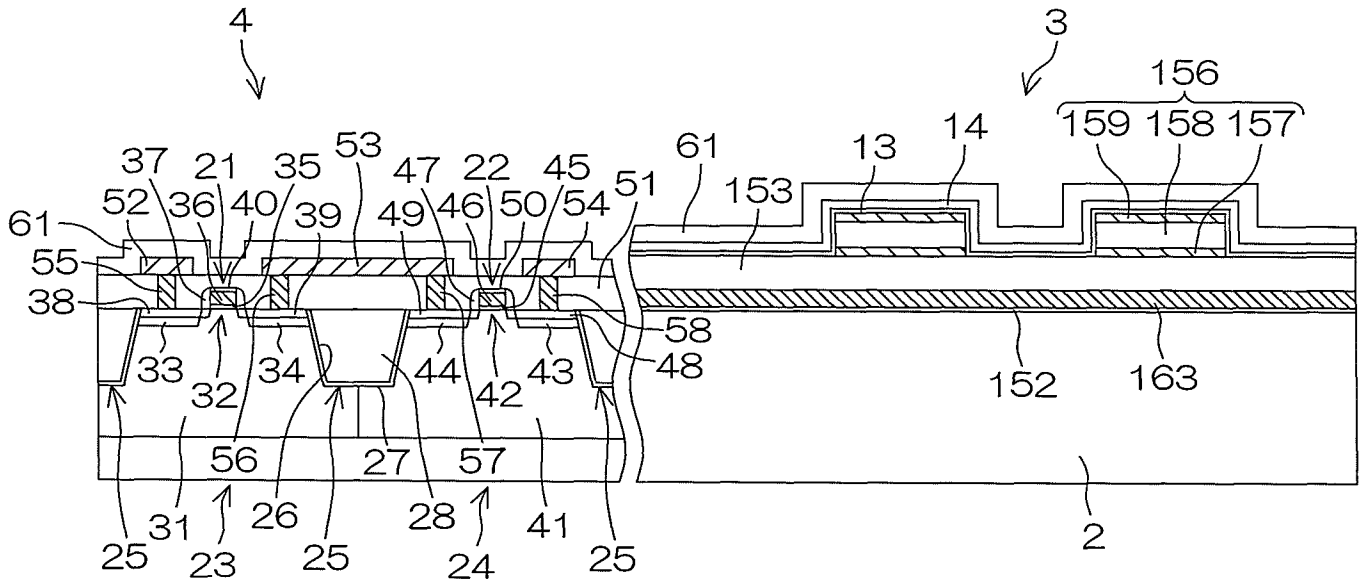

Subsequently, as shown in FIG. 13E, a surface protective film 61 is formed on the interlevel insulating films 14, 51 by a CVD method.

Figure 13F:
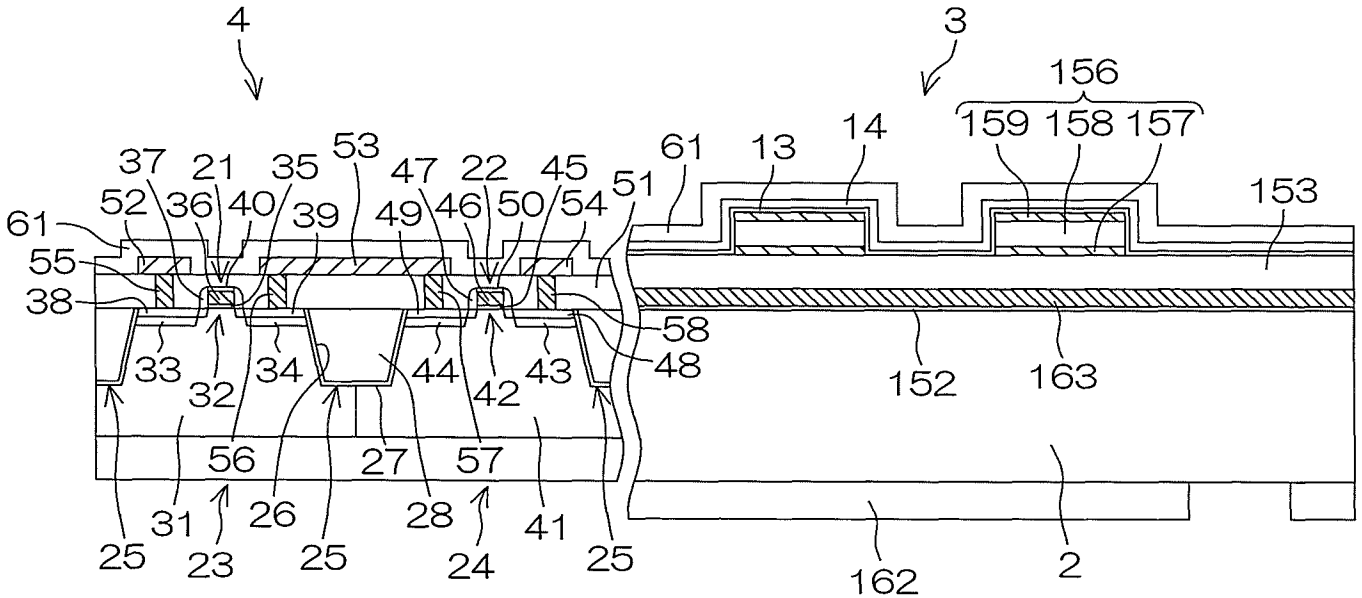

After the formation of the surface protective film 61, as shown in FIG. 13F, a resist pattern 162 is formed on a rear surface of the silicon substrate 2 by photolithography. The resist pattern 162 is configured such as to expose portions of the silicon substrate 2 to be formed with ink supply passages 161 and cover the other portion of the silicon substrate 2.

Figure 13G:
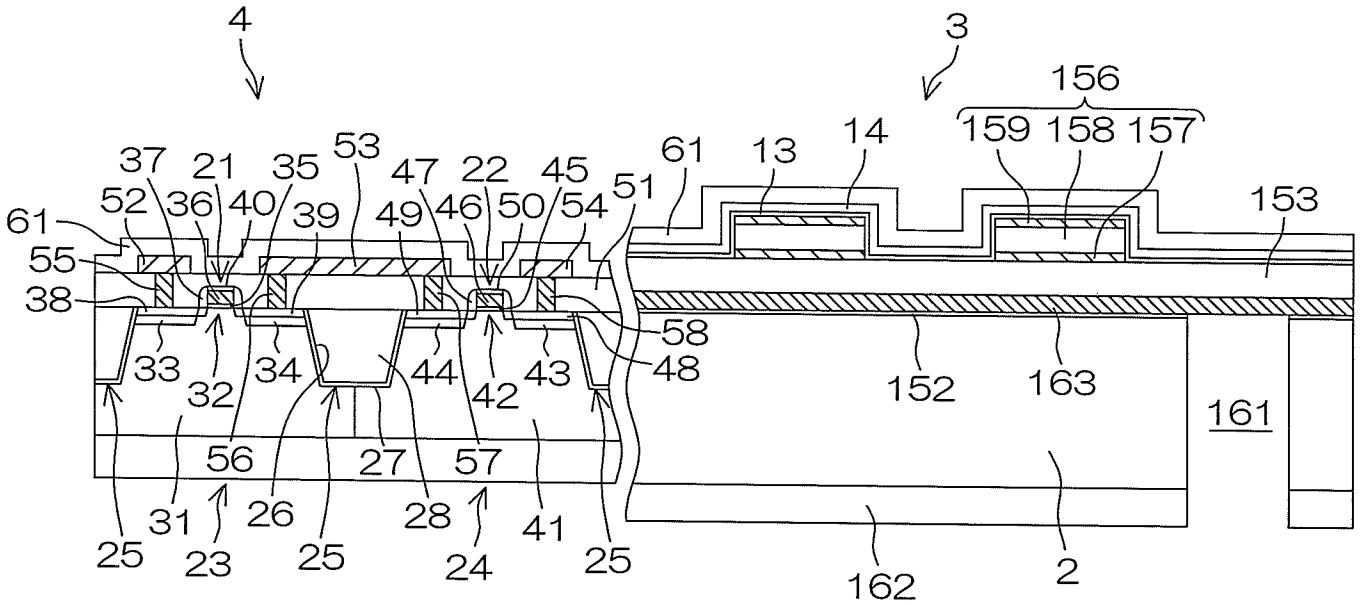
Figure 13H:
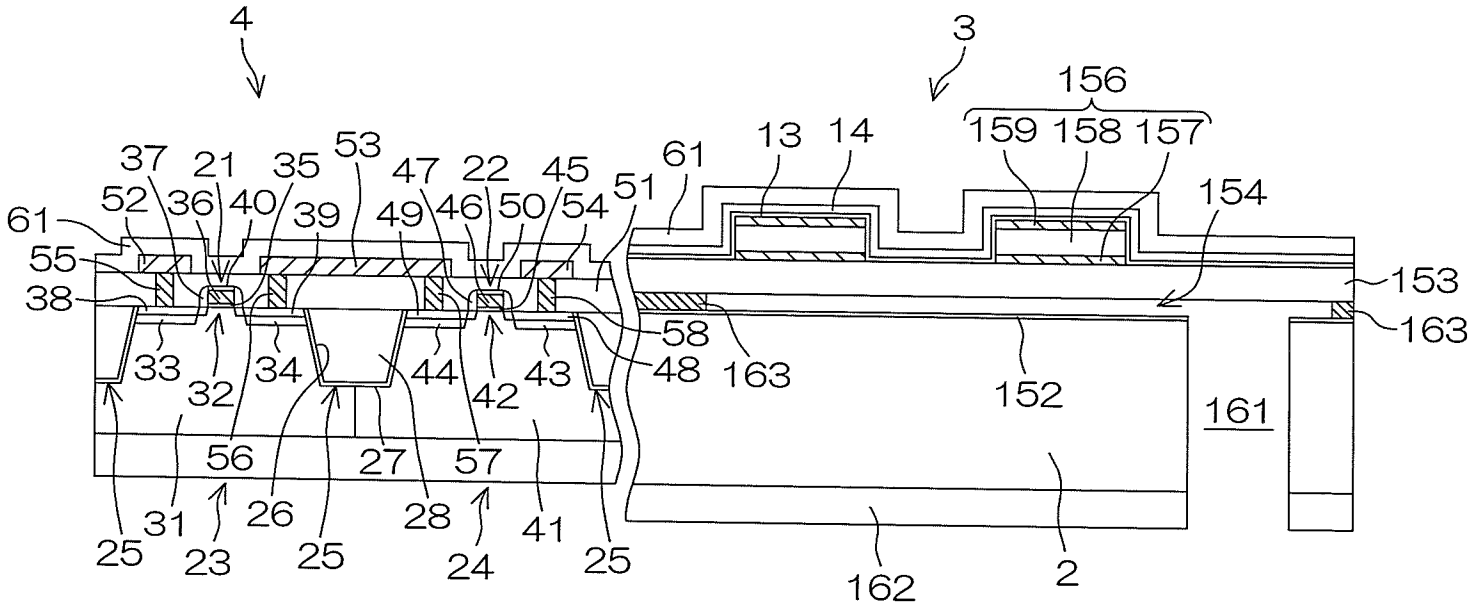

Then, the silicon substrate 2 is wet-etched by using the resist pattern 162 as a mask, whereby the ink supply passages 161 are formed in the silicon substrate 2 as shown in FIG. 13G. Further, an etching liquid capable of etching polysilicon is supplied to the polysilicon layer 87 through the ink supply passages 161, whereby the polysilicon layer 87 (sacrificial layer 163) is partly removed as shown in FIG. 13H. Thus, ink flow passages 154 are formed. Thereafter, the silicon substrate 2 is dry-etched from its front side, whereby nozzles 160 are formed as extending through the hydrogen barrier layer 13, the interlevel insulating film 14 and the surface protective film 61. Thus, the inkjet printer head 151 shown in FIG. 12 is produced.

While the five embodiments of the present invention have thus been described, the invention may be embodied in other ways.

In the inkjet printer heads 1, 101, 111, 131, 151, the silicon substrate 2 is employed as an example of the semiconductor substrate, but a substrate of a semiconductor material other than silicon, such as an SiC (silicon carbide) substrate, may be used instead of the silicon substrate 2.

While the present invention has been described in detail by way of the embodiments thereof, it should be understood that these embodiments are merely illustrative of the technical principles of the present invention but not limitative of the invention. The spirit and scope of the present invention are to be limited only by the appended claims.

This application corresponds to Japanese Patent Application No. 2009-187485 filed in the Japanese Patent Office on Aug. 12, 2009 and Japanese Patent Application No. 2010-120391 filed in the Japanese Patent Office on May 26, 2010, the disclosure of which is incorporated herein by reference in entirety.

What is claimed is:

1. An inkjet printer head comprising:

a semiconductor substrate;

a vibration diaphragm provided on the semiconductor substrate and configured to vibrate in an opposing direction in which the vibration diaphragm is opposed to the semiconductor substrate;

a piezoelectric element provided on the vibration diaphragm;

a pressure chamber, provided on a side of the vibration diaphragm adjacent to the semiconductor substrate, and facing the vibration diaphragm, the pressure chamber being configured to be filled with an ink; and a nozzle extending through the vibration diaphragm and communicating with the pressure chamber via a straight ink path for ejecting the ink supplied from the pressure chamber, the straight ink path having a first end coupled to the pressure chamber and a second end coupled to the nozzle;

wherein the nozzle includes a first surface defining a first region on a side of the first end and a second surface defining a second region on a side of the second end, the second region being nearer to an outside of the inkjet printer head than the first region;

wherein the first surface is a curved surface and inclines with respect to the opposing direction so as to widen the first region gradually toward the pressure chamber and the second surface extends straight along the opposing direction; and wherein a center of curvature of the first surface is disposed so that the first surface curves inward to the semiconductor substrate.

2. The inkjet printer head according to claim 1, further comprising:

a semiconductor element provided in the semiconductor substrate; and an interconnection connected to the semiconductor element.

3. The inkjet printer head according to claim 1, wherein the vibration diaphragm contacts one surface of the semiconductor substrate, and the pressure chamber extends thicknesswise through the semiconductor substrate.

4. The inkjet printer head according to claim 1, wherein the pressure chamber is provided between the semiconductor substrate and the vibration diaphragm.

5. The inkjet printer head according to claim 3, further comprising an ink supply passage provided in the semiconductor substrate and communicating with the pressure chamber.

6. The inkjet printer head according to claim 5, wherein the ink supply passage is located separately from the nozzle as seen in plan.

7. The inkjet printer head according to claim 6, further comprising an ink flow passage connecting the pressure chamber and the ink supply passage.

8. The inkjet printer head according to claim 1, wherein the piezoelectric element has an annular shape to surround the nozzle.

9. The inkjet printer head according to claim 1, wherein the piezoelectric element is disposed on a lateral side of the nozzle.

10. The inkjet printer head according to claim 1, further comprising a driving circuit provided in the semiconductor substrate provided with the vibration diaphragm and adapted to apply a voltage to the piezoelectric element.

11. The inkjet printer head according to claim 1, wherein the second surface is larger than the first surface with respect to the opposing direction and the second surface extends straight along the opposing direction through the entire area of the second region with respect to the opposing direction.

* * * * *